US007928941B2

(12) United States Patent
Yamazaki et al.

(10) Patent No.: US 7,928,941 B2
(45) Date of Patent: Apr. 19, 2011

(54) ELECTRO-OPTICAL DEVICE, DRIVING CIRCUIT AND ELECTRONIC APPARATUS

(75) Inventors: Katsunori Yamazaki, Matsumoto (JP); Yasushi Yamazaki, Azumino (JP)

(73) Assignee: Sony Corporation, Tokyo (JP)

( * ) Notice: Subject to any disclaimer, the term of this patent is extended or adjusted under 35 U.S.C. 154(b) by 742 days.

(21) Appl. No.: 12/000,754

(22) Filed: Dec. 17, 2007

(65) Prior Publication Data

US 2008/0231569 A1 Sep. 25, 2008

(30) Foreign Application Priority Data

Mar. 20, 2007 (JP) ..... 2007-071977

(51) Int. Cl.
*G09G 3/34* (2006.01)

(52) U.S. Cl. ..... 345/84; 345/204; 345/30

(58) Field of Classification Search ..... None
See application file for complete search history.

(56) References Cited

U.S. PATENT DOCUMENTS 4,621,260 A * 11/1986 Suzuki et al. ..... 345/92
5,706,023 A 1/1998 Nagata et al.
5,790,090 A * 8/1998 Libsch et al. ..... 345/94
6,950,080 B2 * 9/2005 Senda et al. ..... 345/55
7,050,038 B2 * 5/2006 Matsuda et al. ..... 345/103
2003/0222838 A1 12/2003 Iida et al.
2006/0209011 A1 * 9/2006 Miyasaka ..... 345/107

FOREIGN PATENT DOCUMENTS

EP 0 622 655 A2 11/1994
JP A 02-157815 6/1990
JP A 2001-083943 3/2001
JP A-2003-344824 12/2003
JP A2006-313319 11/2006

* cited by examiner

*Primary Examiner* — Sumati Lefkowitz
*Assistant Examiner* — Jesus Hernandez
(74) *Attorney, Agent, or Firm* — K&L Gates LLP

(57) ABSTRACT

It is possible to suppress the voltage amplitudes of data lines and to prevent deterioration in display quality by a simple configuration.

Each of pixels 110 includes a pixel capacitor and a storage capacitor of which one end is connected to a pixel electrode and the other end is connected to each capacitive line 132. If first, second, third, . . . , 320$^{th}$, and 321$^{st}$ scanning lines 112 are sequentially selected, the capacitive line 132 of each row is provided with TFTs 152, 154, 156 and 158. A source electrode of the TFT 156 of a first row is connected to a first feed line 165 and a gate electrode thereof is connected to a first scanning line 112. A source electrode of the TFT 158 is connected to a second feed line 167 and a gate electrode thereof is connected to a common drain electrode of the TFTs 152 and 154. The drain electrodes of the TFT 156 and 158 are connected to the first capacitive line 132. A gate electrode of the TFT 152 is connected to a second scanning line 112.

11 Claims, 23 Drawing Sheets

ELECTRO-OPTICAL DEVICE, DRIVING CIRCUIT AND ELECTRONIC APPARATUS

BACKGROUND

1. Technical Field

The present invention relates to a technology for suppressing the voltage amplitudes of data lines by a simple configuration and preventing deterioration in display quality in an electro-optical device such as a liquid crystal device.

2. Related Art

In an electro-optical device such as a liquid crystal device, pixel capacitors (liquid crystal capacitors) are provided in correspondence with intersections of scanning lines and data lines. If the pixel capacitors need to be AC-driven, the voltage amplitudes of data signals have both positive and negative polarities and thus a withstand voltage of a configuration element corresponding to the voltage amplitude is required in a data line driving circuit for supplying the data signals to the data lines. Accordingly, a technology for suppressing the voltage amplitudes of the data signals by providing storage capacitors in parallel to the pixel capacitors and driving a capacitive line commonly connected to the storage capacitors of each row by a binary value in synchronization with the selection of the scanning lines is suggested (JP-A-2001-83943).

However, in this technology, since a circuit for driving the capacitive line is equal to a scanning line driving circuit (substantially, a shift register) for driving the scanning lines, the configuration of the circuit for driving the capacitive line becomes complicated.

SUMMARY

An advantage of some aspects of the invention is that it provides an electro-optical device, a driving circuit and an electronic apparatus, which are capable of suppressing the voltage amplitudes of data lines by a simple configuration.

According to an aspect of the invention, there is provided a driving circuit of an electro-optical device, the driving circuit including: a plurality of rows of scanning lines; a plurality of columns of data lines; a plurality of capacitive lines provided in correspondence with the plurality of rows of scanning lines; pixels provided in correspondence with intersections of the plurality of rows of scanning lines and the plurality of columns of data lines, each of the pixels including: a pixel switching element of which one end is connected to the data line corresponding thereto and which becomes a conduction state when the scanning line corresponding thereto is selected, and of which the other end is suitable for connection to a pixel capacitor interposed between the pixel switching element and a common electrode, and a storage capacitor interposed between the other end of the pixel switching element and the capacitive line provided in correspondence with the scanning line; a scanning line driving circuit which selects the scanning lines in predetermined order; a capacitive line driving circuit which selects a first feed line when one scanning line is selected, selects a second feed line until the one scanning line is selected again after selecting a scanning line that is separated from the one scanning line by a predetermined row and is selected after the one scanning line, and applies voltages of the selected feed lines, with respect to the capacitive line corresponding to the one scanning line; and a data line driving circuit which supplies data signals corresponding to gradations of the pixels to the pixels corresponding to the selected scanning line via data lines.

In the driving circuit of the electro-optical device according to the invention, the voltages of the first and second feed lines may be set such that the voltage of one capacitive line is changed when a scanning line separated from a scanning line corresponding to the one capacitive line by a predetermined row is selected. In addition, the voltage of the first feed line may be switched between two different voltages in a predetermined period, and the voltage of the second feed line may be constant. Furthermore, the voltage of the second feed line may be an intermediate value between two voltages of the first feed line. In addition, the voltages of the first and second feed lines may be complementarily switched between two different voltages whenever the scanning line is selected.

In the driving circuit of the electro-optical device according to the invention, the capacitive line driving circuit may include first to fourth transistors in correspondence with each of the capacitive lines, the first transistor corresponding to one capacitive line may include a gate electrode which is connected to a scanning line separated from the scanning line corresponding to the one capacitive line by a predetermined row and a source electrode which is connected to an on-voltage feed line for feeding an on voltage for turning on the fourth transistor, the second transistor may include a gate electrode which is connected to the scanning line corresponding to the one capacitive line and a source electrode which is connected to an off-voltage feed line for feeding an off voltage for turning off the fourth transistor, the third transistor may include a gate electrode which is connected to the scanning line corresponding to the one capacitive line and a source electrode which is connected to the first feed line, the fourth transistor may include a gate electrode which is commonly connected to drain electrodes of the first and second transistors and a source electrode which is connected to the second feed line, and drain electrodes of the third and fourth transistors may be connected to the one capacitive line. In this configuration, one capacitive line may have a plurality of sets of the first, second and fourth transistors, and the fourth transistor for connecting the one capacitive line to the second feed line may be switched from the plurality of sets in predetermined order. In addition, in this configuration, assistant capacitors may be provided in correspondence with the capacitive lines, and one end of the assistant capacitor corresponding to one capacitive line may be connected to the gate electrode of the fourth transistor and the other end thereof may be held at a constant voltage in a period from a time point when at least a scanning line separated from the scanning line corresponding to the one capacitive line by a predetermined row is selected to a time point when the one scanning line is selected again. Here, the other end of the assistant capacitor corresponding to the one capacitive line may be connected to the scanning line corresponding to the one capacitive line.

In the driving circuit of the electro-optical device according to the invention, the first feed line may be divided into a first feed line for an odd-numbered row and a first feed line for an even-numbered row, the source electrode of the third transistor of the capacitive line corresponding to the odd-numbered row may be connected to the first feed line for the odd-numbered row and the source electrode of the third transistor of the capacitive line corresponding to the even-numbered row may be connected to the first feed line for the even-numbered row, and one of two different voltages may be applied to the first feed line corresponding to the odd-numbered row, the other of the two different voltages may be applied to the first feed line corresponding to the even-numbered row, and the two different voltages may be complementarily switched in a predetermined period.

According to the invention, it is possible to provide an electro-optical device and an electronic apparatus including the electro-optical device as well as the driving circuit of the electro-optical device.

BRIEF DESCRIPTION OF THE DRAWINGS

Embodiments of the invention will be described by way of example only with reference to the accompanying drawings, wherein like numbers reference like elements.

DESCRIPTION OF EXEMPLARY EMBODIMENTS

Hereinafter, embodiments of the invention will be described with reference to the accompanying drawings.

First Embodiment

Figure 1:
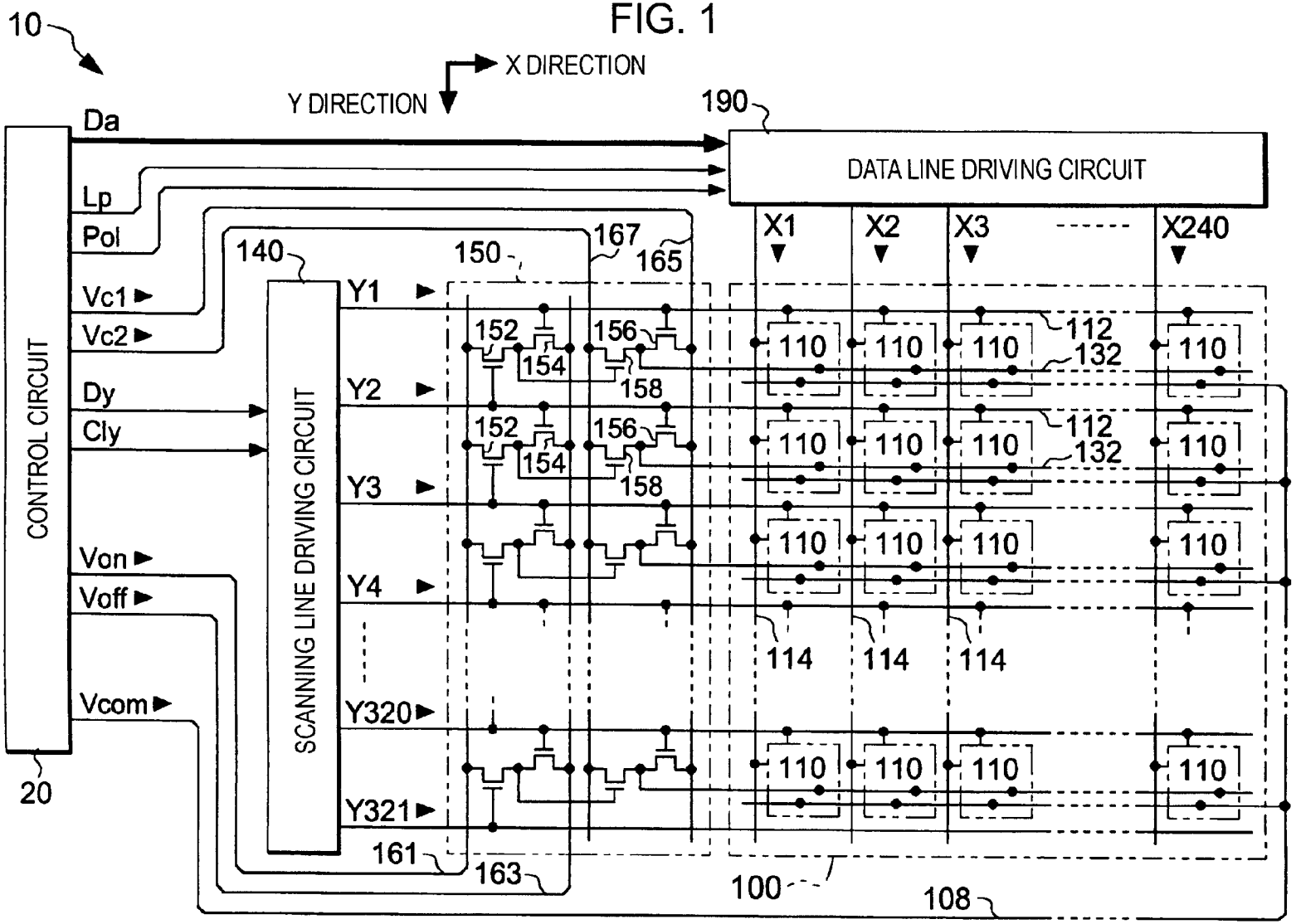
FIG. 1 is a view showing the configuration of an electro-optical device according to a first embodiment of the invention.

First, a first embodiment of the invention will be described. FIG. 1 is a block diagram showing the configuration of an electro-optical device according to the first embodiment of the invention.

As shown in FIG. 1, the electro-optical device 10 has a display region 100, and a control circuit 20, a scanning line driving circuit 140, a capacitive line driving circuit 150, and a data line driving circuit 190 are arranged around the display region. Pixels 110 are arranged in the display region 100. In the present embodiment, 321 scanning lines 112 extend in a row (X) direction and 240 data lines 114 are extend in a column direction. In correspondence with intersections of first to 320th scanning lines 112 excluding a last $321^{st}$ scanning line and first to $240^{th}$ data lines 114, the pixels 110 are arranged. Accordingly, in the present embodiment, the $321^{st}$ scanning line 112 does not contribute to vertical scanning of the display region 100 (an operation for sequentially selecting the scanning lines in order to write a voltage to the pixels 110).

Although, in the present embodiment, the pixels 110 are arranged in a 320×240 matrix in the display region 100, the invention is not limited to this arrangement.

In correspondence with the first to $320^{th}$ scanning lines 112, capacitive lines 132 extend in the X direction. Accordingly, in the present embodiment, the capacitive lines 132 are provided on first to $320^{th}$ rows, excluding $321^{st}$ scanning line 112 which is a dummy.

Next, the detailed configuration of the pixels 110 will be described.

Figure 2:
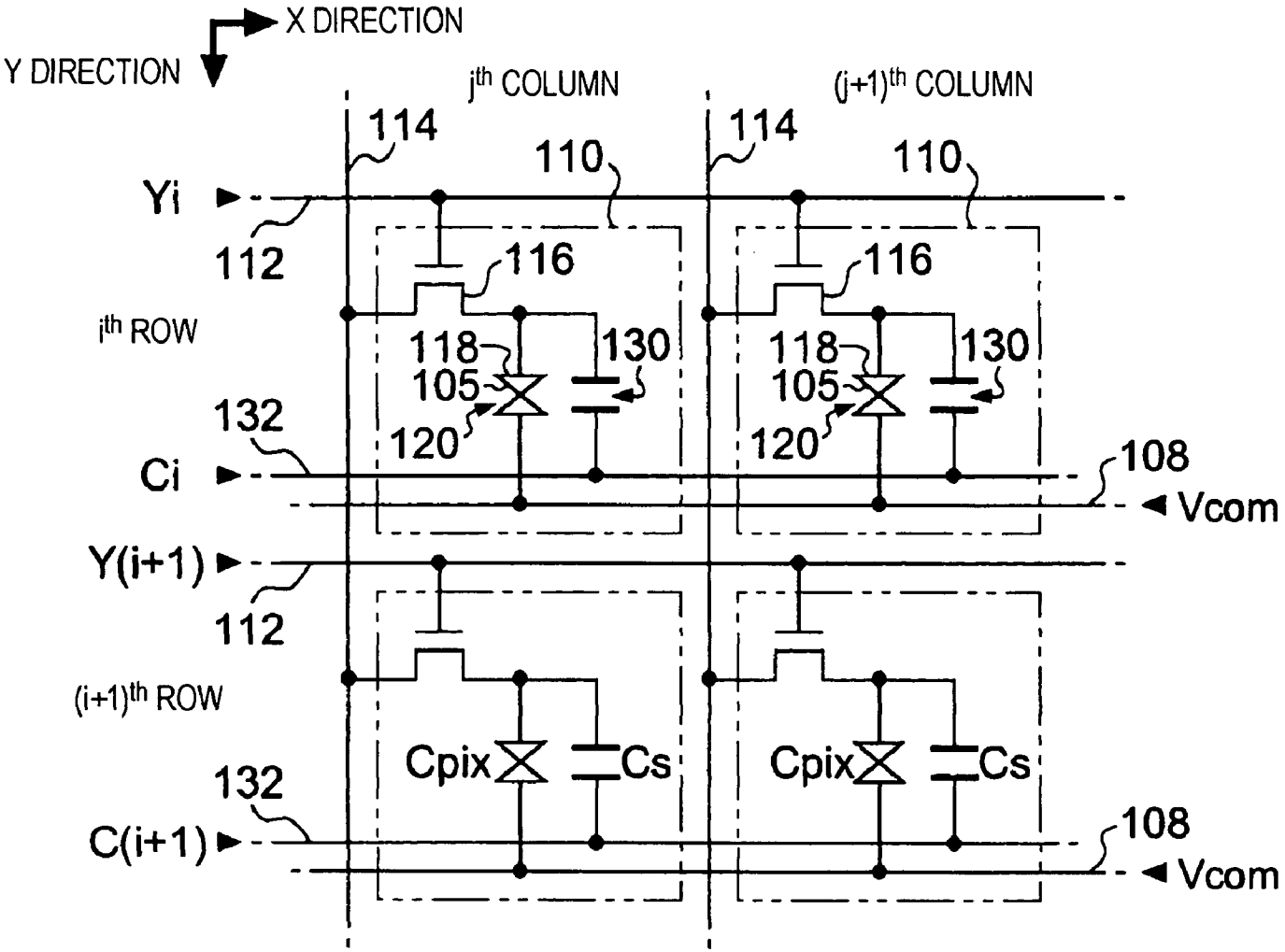
FIG. 2 is a view showing the configuration of pixels of the electro-optical device.

FIG. 2 is a view showing the configuration of the pixels 110 and shows 2×2 pixels including $i^{th}$ row and $(i+1)^{th}$ row adjacent thereto and $j^{th}$ column and $(j+1)^{th}$ column adjacent thereto.

Here, i generally indicates the rows of the pixels 110 and is an integer from 1 to 320 and j and (j+1) generally indicate the columns of the pixels 110 and are an integer from 1 to 240. Here, (i+1) generally indicates the rows of the pixels 110 and is an integer from 2 to 320. However, since the rows of the scanning lines 112 include the $321^{st}$ row which is the dummy, (i+1) is an integer from 2 to 321.

As shown in FIG. 2, each pixel 110 includes an n-channel-type thin-film transistor (hereinafter, abbreviated to "TFT") 116 functioning as a pixel switching element, a pixel capacitor (liquid crystal capacitor) 120 and a storage capacitor 130. Since the pixels 110 have the same configuration, a pixel located at $i^{th}$ row and $j^{th}$ column is described. In the pixel 110 located at the $i^{th}$ row and $i^{th}$ column, a gate electrode of the TFT 116 is connected to the $i^{th}$ scanning line 112, a source electrode thereof is connected to the $j^{th}$ data line 114, and a drain electrode thereof is connected to a pixel electrode 118 which is one end of the pixel capacitor 120.

The other end of the pixel capacitor 120 is connected to a common electrode 108. The common electrode 108 is connected to all the pixels 110 as shown in FIG. 1 and is provided with a common signal Vcom. In the present embodiment, the common signal Vcom is a voltage LCcom which is constant in time, as described below.

In FIG. 2, Yi and Y(i+1) respectively indicate the scanning signals supplied to the $i^{th}$ and $(i+1)^{th}$ scanning lines 112 and Ci and C(i+1) respectively indicate the voltages of the $i^{th}$ and $(i+1)^{th}$ capacitive lines 132.

The display region 100 is formed by attaching a device substrate, on which the pixel electrodes 118 are formed, and a counter substrate, on which the common electrode 108 is formed, to each other at a predetermined gap such that electrode forming surfaces face each other and filling liquid crystal 105 in the gap. Accordingly, the pixel capacitor 120 is configured by the pixel electrodes 118, the common electrode 108 and the liquid crystal 105, which is a dielectric and is interposed between the pixel electrodes 118 and the common electrode 108, and a difference voltage between the pixel electrodes 118 and the common electrode 108 is held. In this configuration, the amount of transmitted light varies according to an effective value of a hold voltage of the pixel capacitor 120. In the present embodiment, for convenience of description, when the effective value of the hold voltage of the pixel capacitor 120 is close to zero, the transmissivity of light becomes a maximum to perform a white display. In contrast, if the amount of transmitted light is decreased as the effective value of the voltage is increased, the transmissivity becomes a minimum and thus a normally white mode in which a black display is performed is set.

One end of the storage capacitor 130 in the pixel 110 located at the $i^{th}$ and $j^{th}$ column is connected to the pixel electrode 118 (the drain electrode of the TFT 116) and the other end is connected to the $i^{th}$ capacitive line 132. Here, capacitive values of the pixel capacitor 120 and the storage capacitor 130 are Cpix and Cs, respectively.

Returning to FIG. 1, the control circuit 20 outputs a variety of control signals to control the units of the electro-optical device 10, supplies a first capacitive signal Vc1 to a first feed line 165, and supplies a second capacitive signal Vc2 to a second feed line 167. The control circuit 20 supplies an on voltage Von to an on-voltage feed line 161, supplies an off voltage Voff to an off-voltage feed line 163, and supplies the common voltage Vcom to the common electrode 108.

The peripheral circuits such as the scanning line driving circuit 140, the capacitive line driving circuit 150 and the data line driving circuit 190 are provided around the display region 100. Among them, the scanning line driving circuit 140 respectively supplies scanning signals Y1, Y2, Y3, . . . , Y320 and Y321 to the first, second, third, . . . , $320^{th}$, and $321^{st}$ scanning lines 112 over one frame period, under the control of the control circuit 20. That is, the scanning line driving circuit 140 selects the first, second third, . . . , $320^{th}$, and $321^{st}$ scanning lines 112 in this order such that the scanning signal to the selected scanning line becomes a H level corresponding to a selection voltage Vdd and the scanning signals to the other scanning lines become a L level corresponding to a non-selection voltage (ground Gnd).

Figure 4:
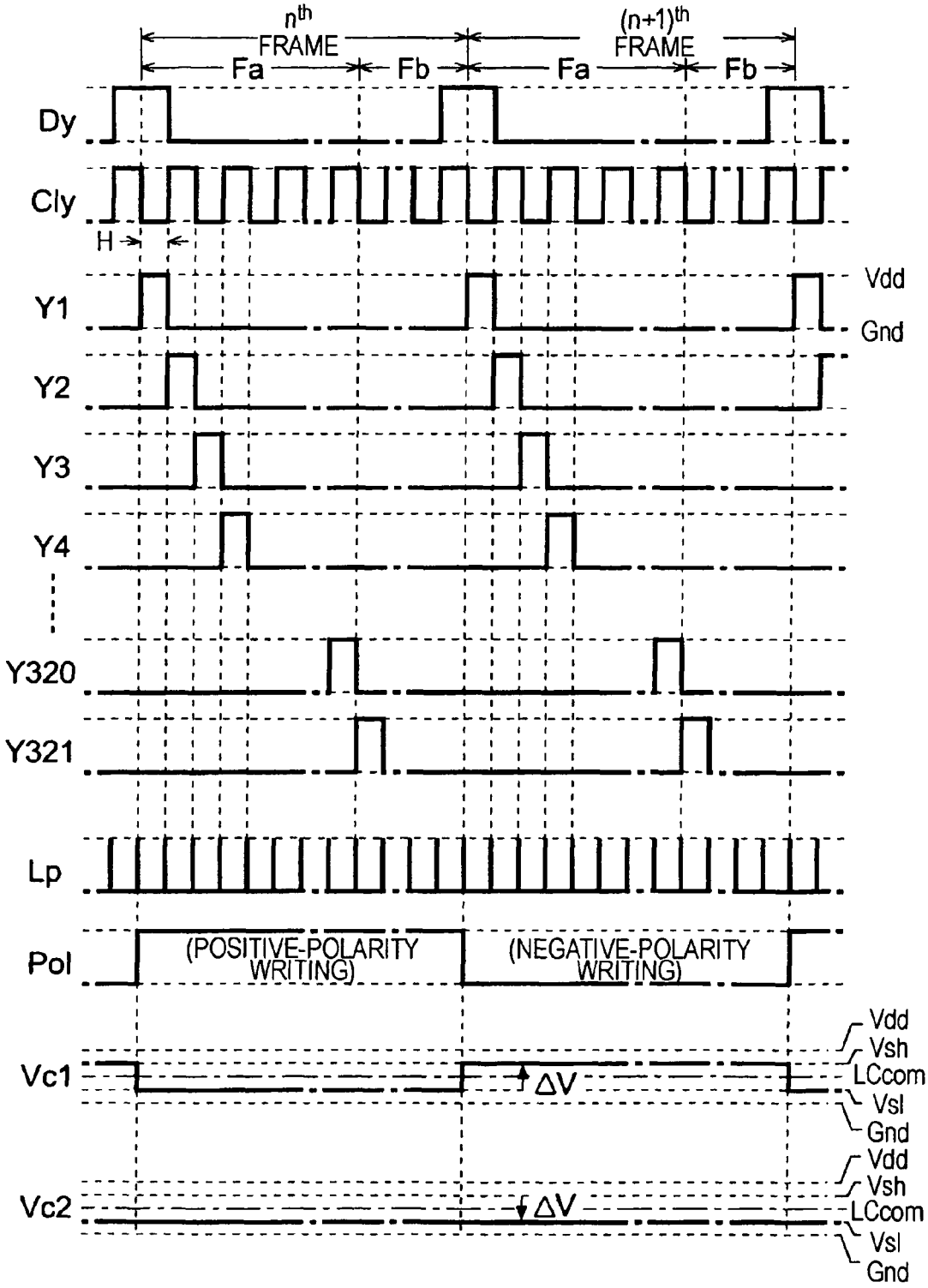
FIG. 4 is a view explaining an operation of the electro-optical device.

In more detail, as shown in FIG. 4, the scanning line driving circuit 140 outputs the scanning signals Y1, Y2, Y3, Y4, . . . , Y320 and Y321 by sequentially shifting a start pulse Dy supplied from the control circuit 20 according to a clock signal Cly.

In the present embodiment, one frame period includes an efficient scanning period Fa from a time point when the scanning signal Y1 becomes the H level to a time point when the scanning signal Y320 becomes the L level and a fly-back period Fb from a time point when the scanning signal Y321 of the dummy becomes the H level to a time point when the scanning signal Y1 becomes the H level again. A period in which one scanning line 112 is selected is a horizontal scanning period H.

In the present embodiment, the capacitive driving circuit 150 is configured by a set of TFTs 152, 154, 156 and 158 provided in correspondence with the first to $320^{th}$ capacitive lines 132. Now, the TFTs 152, 154, 156 and 158 corresponding to the $i^{th}$ capacitive line 132 will be described. A gate electrode of the TFT 152 (first transistor) is connected to the $(i+1)^{th}$ scanning line 112 which is selected next to the $i^{th}$ scanning line and a source electrode thereof is connected to the on-voltage feed line 161. A gate electrode of the TFT 154 (second transistor) located at the $i^{th}$ row is connected to the $i^{th}$ scanning line 112, a source electrode thereof is connected to the off-voltage feed line 163, and the drain electrodes of the TFTs 152 and 154 located at the $i^{th}$ row are connected to a gate electrode of the TFT 158 (fourth transistor) located at the $i^{th}$ row.

In contrast, a gate electrode of the TFT 156 (third transistor) located at the $i^{th}$ row is connected to the $i^{th}$ scanning line 112 and a source electrode thereof is connected to the first feed line 165. A source electrode of the TFT 158 (fourth transistor) located at the $i^{th}$ row is connected to the second feed line 167 and the drain electrodes of the TFTs 156 and 158 are connected to the $i^{th}$ capacitive lines 132.

Here, the on voltage Von supplied to the on-voltage feed line 161 is a voltage for turning on the TFT 158 (the source and drain electrodes are in a conductive state) when being applied to the gate electrode of the TFT 158 and is, for example, a voltage Vdd. The off voltage Voff supplied to the off-voltage feed line 163 is a voltage for turning off the TFT 158 (the source and drain electrodes are in a non-conductive state) when being applied to the gate electrode of the TFT 158 and is, for example, a zero voltage (ground voltage Gnd).

The data line driving circuit 190 supplies data signals X1, X2, X3, . . . , and X240 having voltages according to the gradations of the pixels 110 located at the scanning lines 112 selected by the scanning line driving circuit 14, that is, the voltages having a polarity specified by a polarity specifying signal Pol, to the first, second, third, . . . , and $240^{th}$ data lines 114, respectively.

Here, the data line driving circuit 190 has storage regions (not shown) corresponding to the 320×240 matrix and display data Da for specifying gradation values (brightness) of the corresponding pixels 110 is stored in the storage regions. If the display contents of the display data Da stored in the storage regions are changed, changed display data Da is supplied and rewritten by the control circuit 20 together with an address.

The data line driving circuit 190 reads the display data Da of the pixels 110 located at the selected scanning line 112 from the storage regions, converts the display data into the data signals having the voltages according to the gradation values, that is, the voltages having the specified polarity, and performs an operation for supplying the data signals to the first to $240^{th}$ data lines 114 located at the selected scanning line 112.

Here, if the polarity specifying signal Pol is at the H level, positive-polarity writing is specified and, if the polarity specifying signal Pol is at the L level, negative-polarity writing is specified. As shown in FIG. 4, in the present embodiment, the polarity specifying signal Pol is polarity-inverted in one frame period. That is, in the present embodiment, a surface inversion method in which the polarities written to the pixels in one frame period are the same and the written polarity is inverted in one frame period is employed. Such polarity inversion is to prevent deterioration in the liquid crystal due to application of a DC component.

In the present embodiment, when the voltage according to the gradation is held with respect to the pixel capacitor 120, if the voltage of the pixel electrode 118 is higher than the voltage Vcom (also termed Lccom) of the common electrode 108, the writing polarity is a positive polarity and, if the voltage of the pixel electrode 118 is lower than the voltage Vcom (Lccom) of the common electrode 108, the writing polarity is a negative polarity. Here, the ground voltage Gnd is used unless otherwise described.

The control circuit 20 supplies latch pulses Lp to the data line driving circuit 190 at a timing when a logic level of the clock signal Cly transitions. As described above, since the scanning line driving circuit 140 outputs the scanning signals Y1, Y2, Y3, Y4, . . . , Y320, and Y321 by sequentially shifting the start pulse Dy according to the clock signal Cly, a start timing of a time period when the scanning line is selected is a timing when the logic level of the clock signal Cly transitions. Accordingly, the data line driving circuit 190 can determine which row of scanning lines is selected by continuously counting the latch pulses Lp over one frame period and check the start time of the selection by the supply timings of the latch pulses Lp.

In the present embodiment, the TFTs 152, 154, 156 and 158, the on-voltage feed line 161, the off-voltage feed line 163, the first feed line 165, and the second feed line 167 in the capacitive line driving circuit 150 are formed on the device substrate, in addition to the scanning lines 112, the data lines 114, the TFT 116, the pixel electrode 118, and the storage capacitor 130 in the display region 100.

Figure 3:
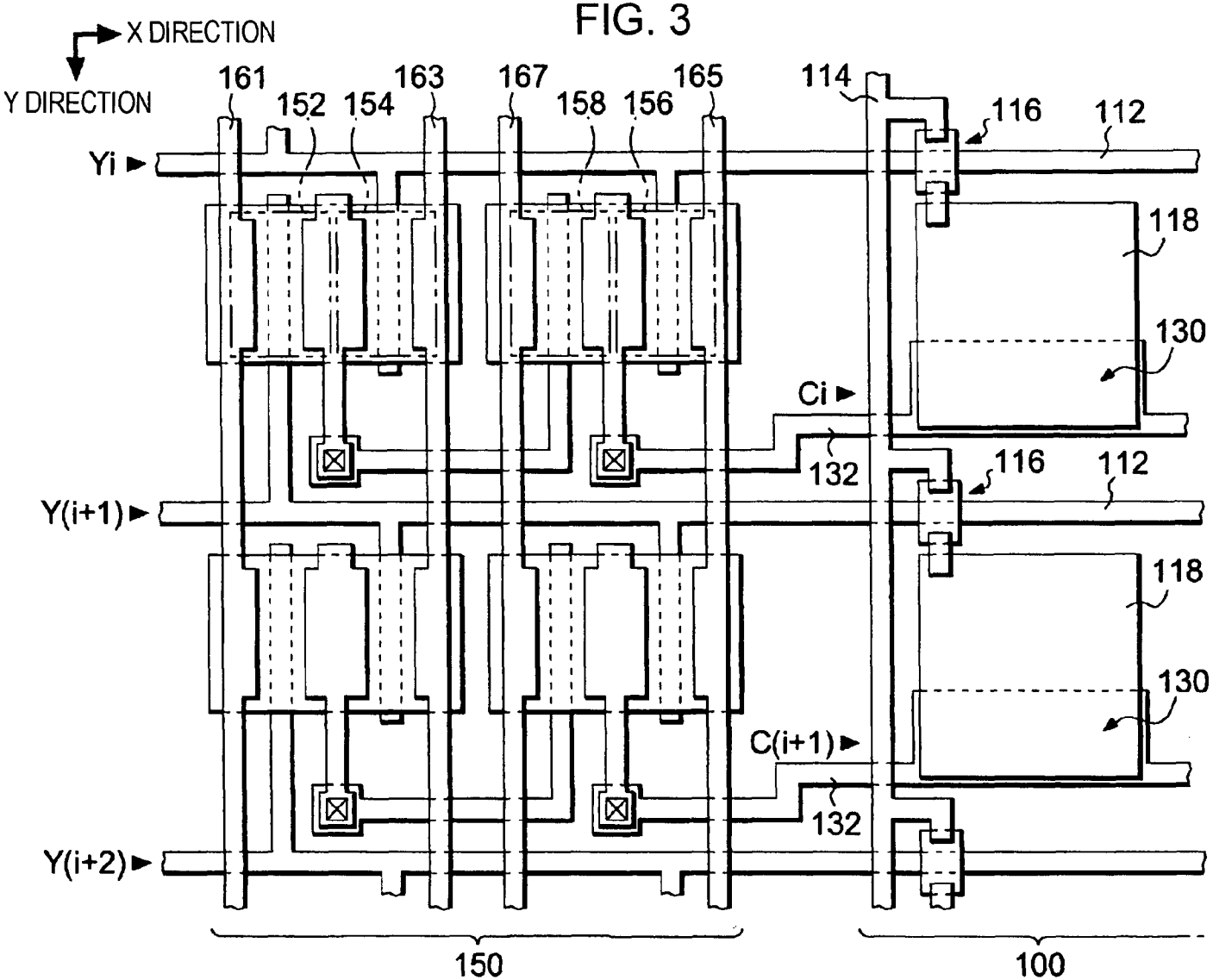
FIG. 3 is a view showing the configuration of a boundary between a display region and a capacitive line driving circuit in the electro-optical device.

FIG. 3 is a view showing the configuration of a boundary between the display region 100 and the capacitive line driving circuit 150 of the device substrate.

As shown in FIG. 3, in the present embodiment, the TFTs 116, 152, 154, 156 and 158 are of amorphous silicon type and a bottom gate type in which the gate electrodes thereof are located below semiconductor layers. In more detail, the scanning lines 112, the capacitive lines 132 and the gate electrode of the TFT 158 are formed by patterning a gate electrode layer which becomes a first conductive layer, a gate insulating film (not shown) is formed on it, and the semiconductor layers of the TFT 116, 152, 154, 156 and 158 are formed in an island shape. After formation of the semiconductor layers, rectangular pixel electrodes 118 are formed by patterning an indium tin oxide (ITO) which becomes a second conductive layer with a protective layer interposed therebetween. The data lines 114, the on-voltage feed line 161, the off-voltage feed line 163, the first feed line 165 and the second feed line 167, all of which become the source electrodes of the TFTs 116, 152, 154, 156 and 158, are formed by patterning a metal layer which is a third conductive layer, such as aluminum, and the drain electrodes of these TFTs are formed.

The gate electrodes of the TFTs 154 and 156 are branched from the scanning line 112 in the Y (downward) direction in a T-shape and the gate electrode of the TFT 152 is branched from the scanning line 112 in the Y (upward) direction in a T-shape. The storage capacitor 130 is configured by the pixel electrode 118, a large-width portion of the capacitive line 132 located at the lower layer of the pixel electrode 118, and the gate insulating film interposed therebetween as a dielectric material.

The common drain electrode of the TFTs 152 and 154 and the gate electrode of the TFT 158 are connected to each other via a contact hole (indicated by × in the drawing) passing through the gate insulating film. Similarly, the common drain electrode of the TFTs 156 and 158 and the capacitive line 132 are connected to each other via another contact hole (indicated by × in the drawing).

The common electrode 108 facing the pixel electrode 118 is formed on the counter substrate and thus is not shown in FIG. 3 which is a plan view of the device substrate.

FIG. 3 is only exemplary and the TFT may have another structure. For example, the TFT may be of a top gate type in view of the gate electrode and/or may be of a polysilicon type in view of a process. In addition, instead of elements of the capacitive line driving circuit 150 being formed adjacent the display region 100, an IC chip may be mounted on the device substrate.

If the IC chip is mounted on the device substrate, the scanning line driving circuit 140 and the capacitive line driving circuit 150 may be integrally mounted as a semiconductor chip, together with the data line driving circuit 190, may be separately mounted, may be connected to the control circuit 20 via a flexible printed circuit (FPC) substrate, or may be mounted on the device substrate as the semiconductor chip.

In the present embodiment, if a reflective type device is used instead of a transmissive type device, the pixel electrode 118 may be obtained by patterning a reflective conductive layer or a separate reflective metal layer may be included. A semi-transmissive semi-reflective type device which is a combination of the transmissive type and reflective type devices may be employed.

Next, an operation of the electro-optical device 10 according to the present embodiment will be described.

As described above, in the present embodiment, the surface inversion method is employed. Accordingly, the control circuit 20 specifies the positive-polarity writing as the H level in any frame ("$n^{th}$ frame") period and specifies the negative-polarity writing as the low level in a next $(n+1)^{th}$ frame period, with respect to the polarity specifying signal Pol, as shown in FIG. 4. The writing polarity is inverted in one frame period.

The control circuit 20 sets the first capacitive signal Vc1 and the second capacitive signal Vc2 to be equal to each other in the $n^{th}$ frame and sets the first capacitive signal Vc1 to be higher than the second capacitive signal Vc2 by a voltage ΔV. Accordingly, as shown in FIG. 4, if the second capacitive signal Vc2 is uniformly set to a voltage Vs1 regardless of the writing polarity, the first capacitive signal Vc1 has the same voltage Vs1 in the $n^{th}$ frame and has a voltage Vsh higher than the voltage Vs1 by ΔV in the $(n+1)^{th}$ frame.

However, in the $n^{th}$ frame, the scanning signal Y1 first becomes the H level by the scanning line driving circuit 140.

If the latch pulse Lp is output at a timing when the scanning signal Y1 becomes the H level, the data line driving circuit 190 reads the display data Da of pixels located at the first row and the first, second, third, and $240^{th}$ columns and converts the display data into the data signals X1, X2, X3, . . . , and X240 which is higher than the voltage LCcom by the voltage specified by the display data Da, and supplies the data signals to the first, second, third, . . . , and $240^{th}$ data lines 114, respectively.

Accordingly, for example, a positive-polarity voltage, which is higher than the voltage LCcom by an amount specified by the display data Da of the pixel 110 located at the first row and the $j^{th}$ column, is applied to a $j^{th}$ data line 114 as a data signal Xj.

At the same time, when the scanning signal Y1 becomes the H level, the TFTs 116 of the pixels located at the first row and the first column to the first row and the $240^{th}$ column are turned on and thus the data signals X1, X2, X3, . . . , and X240 are applied to the pixel electrodes 118. Accordingly, the positive-polarity voltages according to the respective gradations are written to the first row and the first column to the first row and the $240^{th}$ column.

If the scanning signal Y1 is at the H level, the capacitive line driving circuit 150 turns on the TFTS 154 and 156 corresponding to the first capacitive line 132 and turns off the TFT 152 (the scanning signal Y2 is at the L level). Accordingly, the off voltage Voff is applied to the gate electrode of the TFT 158 such that the TFT 158 is turned off, and the first capacitive line 132 is connected to the first feed line 165 to have the voltage Vs1. Accordingly, the difference voltages between the positive-polarity voltages according to the respective gradations and the voltage Vs1 are applied to the first row and the first column to the first row and the $240^{th}$ column storage capacitors 130.

Next, the scanning signal Y1 becomes the L level and the scanning signal Y2 becomes the H level.

If the scanning signal Y1 becomes the L level, the TFTs 116 of the pixels located at the first row and the first column to the first row to the $240^{th}$ column are turned off. If the scanning signal Y1 becomes the L level and the scanning signal Y2 becomes the H level, the capacitive line driving circuit 150 turns off the TFTs 154 and 156 corresponding to the first capacitive line 132 and turns on the TFT 152 located at the first row. Accordingly, the on voltage Von is applied to the gate electrode of the TFT 158 located at the first row such that the TFT 158 is turned on, and the first capacitive line 132 is connected to the second feed line 167. However, in the $n^{th}$ frame for specifying the positive-polarity writing, the second feed line 167 has the same voltage as the first feed line 165 and thus the voltage of the second feed line 167 is not changed.

Accordingly, if the polarity specifying signal Pol is at the H level and the positive-polarity writing is specified, the voltages of the pixel capacitors 120 and the storage capacitors 130 located at the first row and the first column to the first row and the $240^{th}$ column are not changed although the scanning signal Y2 is at the H level.

If the latch pulse Lp is output at a timing when the scanning signal Y2 becomes the H level, the data line driving circuit 190 supplies the data signals X1, X2, X3, . . . , and X240 having the positive-polarity voltages according to the gradations of the pixels located at the second row and the first, second, third, . . . , and $240^{th}$ column to the first, second, third, . . . , and $240^{th}$ data lines 114, respectively. When the scanning signal Y2 becomes the H level, the TFTs 116 of the pixels located at the second row and the first column to the second row and the $240^{th}$ column are turned on such that the data signals X1, X2, X3, . . . , and X240 are applied to the pixel electrodes 118 thereof. Thus, the positive-polarity voltages according to the respective gradations are written to the pixel capacitors 120 located at the second row and the first column to the second row and the $240^{th}$ column.

If the scanning signal Y2 is at the H level, the capacitive line driving circuit 150 turns on the TFTs 154 and 156 corresponding to the second capacitive line 132, but turns off the TFT 152 located at the second row (the scanning signal Y3 is at the L level). Accordingly, the TFT 158 located at the second row is turned off. Accordingly, since the second capacitive line 132 has the voltage Vs1, the difference voltages between the positive-polarity voltages according to the gradations and the voltage Vs1 are written to the storage capacitors 130 located at the second row and the first column to the second row and the $240^{th}$ column.

Next, the scanning signal Y2 becomes the L level and the scanning signal Y3 becomes the H level.

If the scanning signal Y2 becomes the L level, the capacitive line driving circuit 150 turns off the TFT 152 corresponding to the first capacitive line 132. Accordingly, the gate electrode of the TFT 158 corresponding to the first capacitive line 132 becomes a high impedance state in which no electrical connection is made, and is held at the on voltage Von immediately before the TFT 152 located at the first row is turned off, because of the parasitic capacitance of the gate electrode. Accordingly, since the TFT 158 corresponding to the first capacitive line 132 is continuously in the on state, the first capacitive line 132 is held at the voltage Vs1. The operation for allowing the first capacitive line 132 to be held at the voltage Vs1 is continuously performed until the scanning signal Y1 becomes the H level again.

Since the first capacitive line 132 is held at the voltage Vs1, the voltages held in the pixel capacitors 120 and the storage capacitors 130 located at the first row and the first column to the first row and the $240^{th}$ column are not changed until the scanning signal Y1 becomes the H level. As a result, the pixel capacitors 120 located at the first row and the first column to the first row and the $240^{th}$ column are held at the difference voltage between the voltages of the data signals applied to the pixel electrodes 118 and the voltage LCcom of the common electrode 108, that is, the voltages according to the gradations.

If the latch pulse Lp is output at a timing when the scanning signal Y3 becomes the H level, the data line driving circuit 190 supplies the data signals X1, X2, X3, . . . , and X240 having the positive-polarity voltages according to the gradations of the pixels located at the third row and the first, second, third, . . . , and $240^{th}$ column to the first, second, third, . . . , and $240^{th}$ data lines 114, respectively. Thus, the positive-polarity voltages according to the respective gradations are written to the pixel capacitors 120 located at the third row and the first column to the third row and the $240^{th}$ column.

If the scanning signal Y3 is at the H level, the capacitive line driving circuit 150 turns on the TFTs 154 and 156 corresponding to the third capacitive line 132, but turns off the TFT 152 located at the third row (the scanning signal Y4 is at the L level). Accordingly, the TFT 158 located at the third row is turned off. Accordingly, since the third capacitive line 132 has the voltage Vs1, the difference voltages between the positive-polarity voltages according to the gradations and the voltage Vs1 are written to the storage capacitors 130 located at the third row and the first column to the third row and the $240^{th}$ column.

In the $n^{th}$ frame period in which the polarity specifying signal Pol becomes the H level, the same operation is repeated until the scanning signal Y321 becomes the H level. Accordingly, all the pixel capacitors 120 are held at the voltages of the data signals applied to the pixel electrodes 118, that is, the difference voltages between the positive-polarity voltages according to the gradations and the voltage LCcom of the common electrode 108, and all the storage capacitors 130 are held at the difference voltage between the positive-polarity voltages according to the gradations and the voltage Vs1.

Next, in the control circuit 20, the operation of the $(n+1)^{th}$ frame in which the polarity specifying signal Pol becomes the L level will be described.

The operation of the $(n+1)^{th}$ frame is different from the operation of the $n^{th}$ frame in the following two points. That is, first, the control circuit 20 sets the first capacitive line Vc1 to the voltage Vsh higher than the voltage Vsl by ΔV. Second, the operation of the $(n+1)^{th}$ frame is similar to that of the $n^{th}$ frame in that, if the latch pulse Lp is output at a timing when the scanning signal Yi becomes the H level, the data line driving circuit 190 reads the display data Da of the pixels located at the $i^{th}$ row and the first, second, third, . . . , and $240^{th}$ columns, but is different from that of the $n^{th}$ frame in that the data signals X1, X2, X3, . . . , and X240 correspond to the display data Da and are set to the voltages corresponding to the negative polarity (the meaning thereof will be described later).

Accordingly, the operation of the $(n+1)^{th}$ frame will be described concentrating on the difference and more particularly how the voltage written to the pixel capacitor 120 located at the $i^{th}$ row and the $j^{th}$ column when the scanning signal Yi becomes the H level is changed when the scanning signal Y(i+1) becomes the H level.

FIG. 5 is a view explaining a variation in voltage of the pixel capacitor 120 located at the $i^{th}$ row and the $j^{th}$ column in the $(n+1)^{th}$ frame.

Figure 5A:
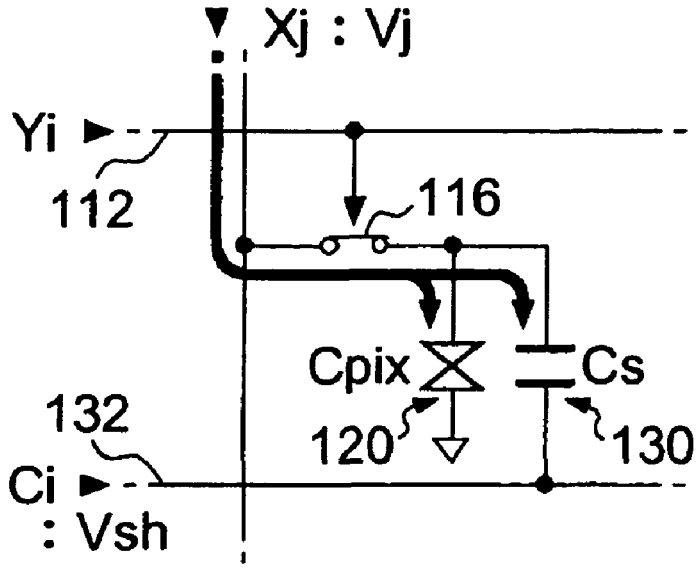
FIG. 5 is a view showing negative-polarity writing of the electro-optical device.

First, if the scanning signal Yi becomes the H level, as shown in FIG. 5A, the TFT 116 located at the $i^{th}$ row and the $j^{th}$ column is turned on and thus the data signal Xj is applied to one end (pixel electrode 118) of the pixel capacitor 120 and one end of the storage capacitor 130. Moreover, when the scanning signal Yi is at the H level, the capacitive line driving circuit 150 turns on the TFTs 154 and 156 corresponding to the $i^{th}$ capacitive line 132 and turns off the TFTs 152 and 158. Thus, the voltage Ci of the $i^{th}$ capacitive line 132 becomes the voltage Vsh of the first feed line 165. The common electrode 108 is held at the voltage LCcom.

Accordingly, if the voltage of the data signal Xj at this time is Vj, a voltage Vj-LCcom is charged in the pixel capacitor 120 located at the $i^{th}$ row and the $j^{th}$ column and a voltage Vj-Vsh is charged in the storage capacitor 130.

Figure 5B:
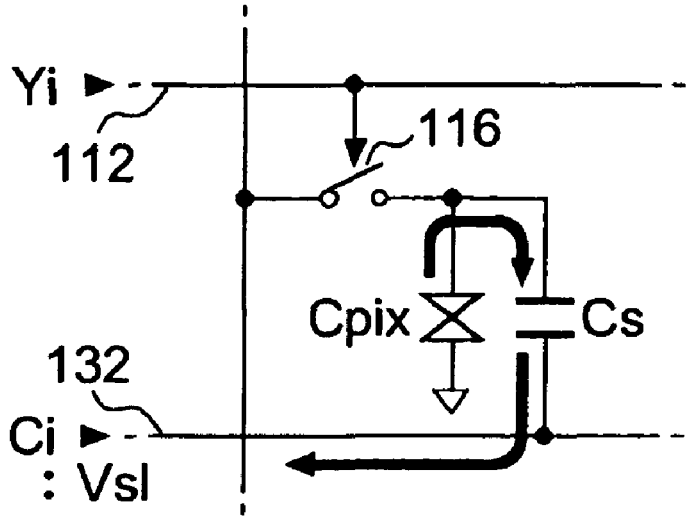

Next, if the scanning signal Yi becomes the L level, as shown in FIG. 5B, the TFT 116 located at the $i^{th}$ row and the $j^{th}$ column is turned off. If the scanning signal Yi becomes the L level, the next scanning signal Y(i+1) becomes the H level (the $(i+1)^{th}$ row is not shown in FIG. 5B). Accordingly, the capacitive line driving circuit 150 turns off the TFTs 154 and 156 corresponding to the $i^{th}$ capacitive line 132 and turns on the TFT 152 located at the $i^{th}$ row, and the on voltage Von is applied to the gate electrode of the TFT 158 located at the $i^{th}$ row. Accordingly, since the TFT 158 located at the $i^{th}$ row is turned on, the voltage Ci of the $i^{th}$ capacitive line 132 becomes the voltage Vsl of the second feed line 167 and is decreased by the voltage ΔV compared with the case where the scanning signal Yi becomes the H level. In contrast, the common electrode 108 is held at the voltage LCcom. Thus, since the charges stored in the pixel capacitor 120 are moved to the storage capacitor 130, the voltage of the pixel electrode 118 is decreased.

In more detail, in the serial connection between the pixel capacitor 120 and the storage capacitor 130, since the other end of the storage capacitor 130 is decreased by the voltage ΔV while the other end (common electrode) of the pixel capacitor 120 is held at a predetermined voltage, the voltage of the pixel electrode 118 is also decreased.

Accordingly, the voltage of the pixel electrode 118 which is a serial connection point becomes $$Vj-\{Cs/(Cs+Cpix)\}\cdot\Delta V$$

Where Cs is the capacitance of the storage capacitor 130 and Cpix is the capacitance of the pixel capacitor 120. Thus, the voltage of the pixel is decreased from the voltage Vj of the data signal when the scanning signal Yi was at the H level, by a value obtained by multiplying a variation ΔV in voltage of the $i^{th}$ capacitive line 132 by a capacitance ratio {Cs/(Cs+Cpix)} of the pixel capacitor 120 and the storage capacitor 130. That is, the voltage Ci of the $i^{th}$ capacitive line 132 is decreased by ΔV, the voltage of the pixel electrode 118 is decreased from the voltage Vj of the data signal when the scanning signal Yi was at the H level, by {Cs/(Cs+Cpix)}·ΔV(=ΔVpix). The parasitic capacitance of each portion is ignored.

The data signal Xj when the scanning signal Yi is at the H level is set to the voltage Vj taking the decrease of the pixel electrode 118 by the voltage ΔVpix into consideration. That is, the voltage of the pixel electrode 118 after the decrease is lower than the voltage LCcom of the common electrode 108 and the difference voltage therebetween is set to become a value according to the gradation of the $i^{th}$ row and the $j^{th}$ column.

Figure 7:
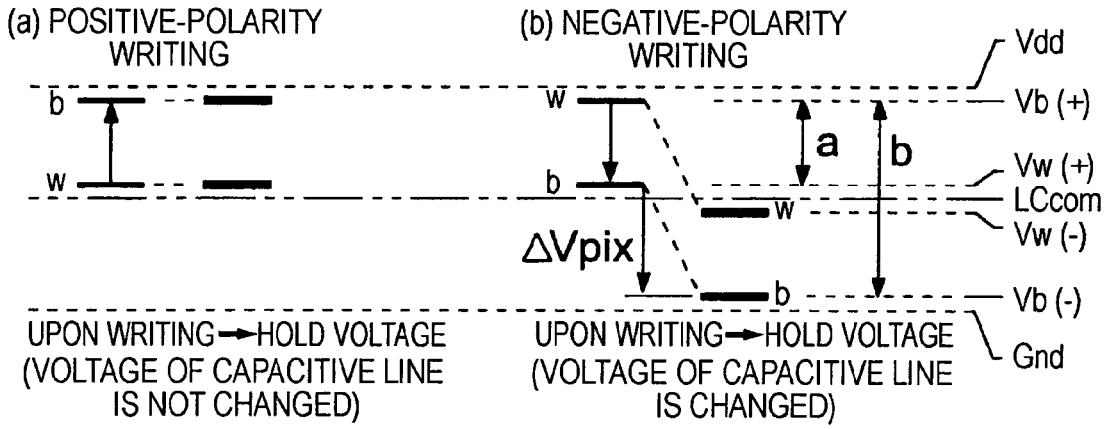
FIG. 7 is a view showing a relationship between a data signal and a hold voltage of the electro-optical device.

In more detail, in the present embodiment, as shown in FIG. 7, in the $n^{th}$ frame for the positive-polarity writing, the data signal is in a range from a voltage Vw(+) corresponding to a white color w to a voltage Vb(+) corresponding to a black color (b). If the voltage LCcom becomes higher as the gradation is decreased (darkness is increased), in the $(n+1)^{th}$ frame for the negative-polarity writing, the voltage Vb(+) is set when the pixel is set to the white color w and the voltage Vw(+) is set when the pixel is set to the black color b. Second, after the voltage of the data signal is written in the $(n+1)^{th}$ frame, when the pixel electrode 118 is decreased by the voltage ΔVpix, the voltage of the pixel electrode 118 is in a range from the voltage Vw(−) corresponding to the white color having the negative polarity to the voltage Vb(−) corresponding to the black color and the decrease Vsh-Vs1 of the voltage ΔV of the capacitive line 132 is set so as to be symmetrical to the positive-polarity voltage with respect to the voltage LCcom.

Accordingly, in the $(n+1)^{th}$ frame specifying the negative-polarity writing, the voltage of the pixel electrode 118 decreased by the voltage ΔVpix is in a range of the negative-polarity voltage according to the gradation, that is, from the voltage Vw(−) corresponding to the white color w to the voltage Vb(−) corresponding to the black color b and is shifted to a voltage lower than the voltage LCcom as the gradation is decreased (darkness is increased).

Although the pixel capacitor 120 and the storage capacitor 130 located at the $i^{th}$ row and the $j^{th}$ column have been described, the same operation is performed with respect to all pixels corresponding to the $i^{th}$ scanning line 112 and capacitive line 132. With respect to the $(n+1)^{th}$ frame, since the scanning signals Y1, Y2, Y3, . . . , Y320, and Y321 sequentially become the H level similar to the $n^{th}$ frame, the operations of the rows are sequentially performed with respect to the pixels located at the first, second, third, . . . , and $320^{th}$ rows.

In the present embodiment, the voltage range a of the data line in the $(n+1)^{th}$ frame for specifying the negative-polarity writing is equal to that of the $n^{th}$ frame for specifying the positive-polarity writing, but the voltage of the pixel electrode 118 after shift becomes the negative-polarity voltage according to the gradation. According to the present embodiment, since the withstand voltage of the element configuring the data line driving circuit 190 may be small and the voltage amplitude of the data line 114 having the parasitic capacitance may become small, power is not unnecessarily consumed by the parasitic capacitance.

That is, in the configuration in which the common electrode 108 is held at the voltage LCcom and the voltage of the capacitive line 132 is constant over each frame, if the pixel capacitor 120 is AC-driven and the gradation is not changed when a voltage in a range according to the gradation from the positive-polarity voltage Vw(+) to the voltage Vb(+) is written to the pixel electrode 118 in any frame, a voltage which is in a range from the voltage Vw(−) corresponding to the negative polarity to the voltage Vb(−) and is inverted on the basis of the voltage LCcom should be written in a next frame. Accordingly, in the configuration in which the voltage of the common electrode 108 is constant, since the voltage of the data signal is in a range b of the drawing when the voltage of the capacitive line 132 is constant, the withstand voltage of the element configuring the data line driving circuit 190 does not need to correspond to the range b. In addition, if the voltage of the data line 114 having the parasitic capacitance is changed in the range b, power is unnecessarily consumed by the parasitic capacitance. In contrast, in the present embodiment, since the voltage range a of the data line is smaller than the range b, these problems are solved.

Figure 6:
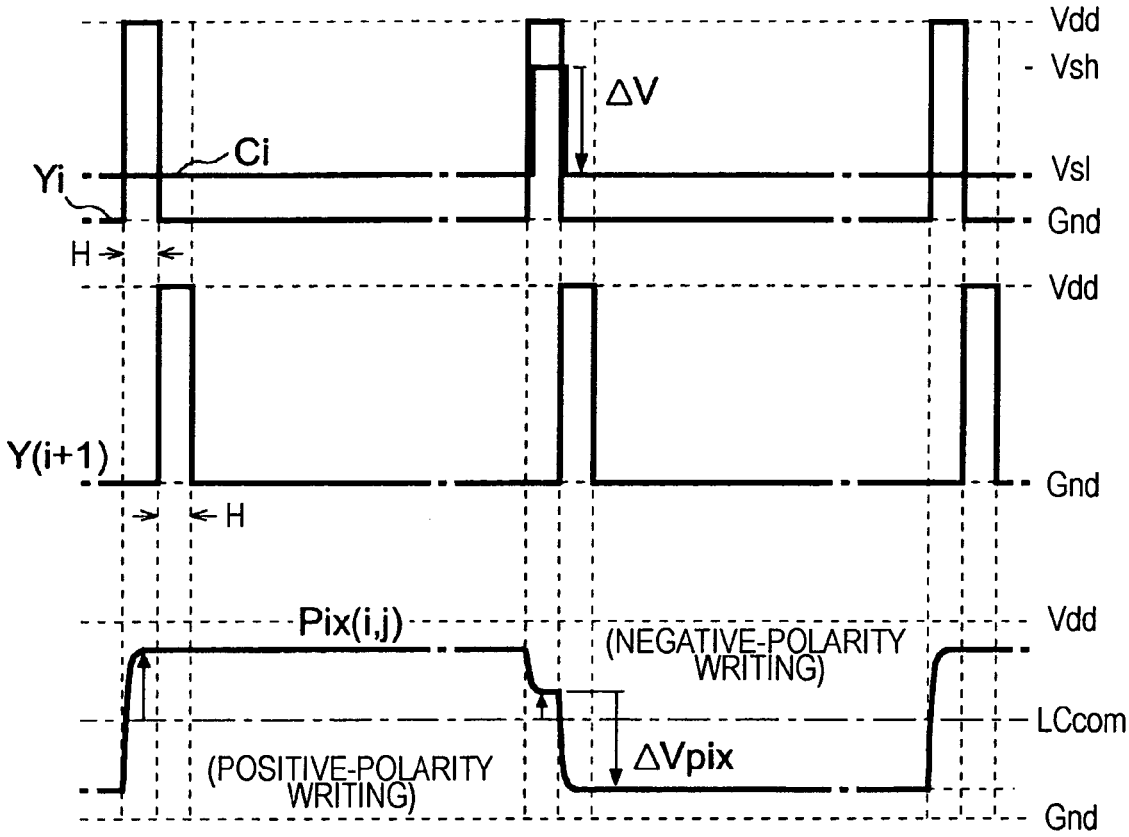
FIG. 6 is a voltage waveform diagram explaining the operation of the electro-optical device.

According to the present embodiment, as shown in FIG. 6, in the frame for specifying the positive-polarity writing, the voltage Ci of the $i^{th}$ capacitive line 132 becomes the voltage Vsl of the first feed line 165 when the scanning signal Yi becomes the H level and becomes the voltage Vsl of the second feed line 167 when the next scanning signal Y(i+1) becomes the H level. Accordingly, the voltage Ci of the $i^{th}$ capacitive line 132 is not changed at a timing when the scanning signal Y(i+1) becomes the H level, in the frame for specifying the positive-polarity writing.

In contrast, in the frame for specifying the negative-polarity writing, the voltage Ci of the $i^{th}$ capacitive line 132 becomes the voltage Vsh when the scanning signal Yi becomes the H level and becomes the voltage Vsl of the second feed line 167 when the next scanning signal Y(i+1) becomes the H level. Accordingly, the voltage Ci of the $i^{th}$ capacitive line 132 is decreased by the voltage ΔV at a timing when the scanning signal Y(i+1) becomes the H level, in the frame for specifying the negative-positive writing.

In the present embodiment, four TFTs 152, 154, 156 and 158 are enough for driving one capacitive line 132 and a separate control signal or control voltage is unnecessary. Accordingly, it is possible to prevent the configuration of the capacitive line driving circuit 150 for driving the capacitive line corresponding to each row from becoming complicated.

FIG. 6 is a view showing a voltage relationship among the scanning signal, the capacitive line and the pixel electrode and shows a variation in voltage of the pixel electrode 118 located at the $i^{th}$ row and the $j^{th}$ column in Pix(i, j).

According to the present embodiment, since the gate electrode of the TFT 158 corresponding to the $i^{th}$ capacitive line 132 is held at the on voltage Von by the parasitic capacitance thereof even after the scanning signal Y(i+1) is changed to the L level, the TFT 158 is continuously in the on state and thus the $i^{th}$ capacitive line 132 is stabilized to the voltage of the second capacitive signal Vc2 without becoming a high impedance state. Since the capacitive lines 132 cross the first to $240^{th}$ data line 114, the capacitive lines 132 are susceptible to be influenced by the variations in voltages of the data signals X1 to X240. In addition, since the capacitive lines 132 are parallel to the scanning lines 112, the capacitive lines are susceptible to be influenced by the variations in voltages of the scanning signals. If the capacitive lines 132 are not stabilized to the voltage of the second capacitive signal Vc2, the voltages of the capacitive lines 132 are changed by the variations in voltages thereof. If the voltages of the capacitive lines 132 are changed, the voltage held in the pixel capacitor 120 is shifted from the voltage according to target gradation and the display quality is affected. However, according to the present embodiment, since the voltages of the capacitive lines 132 are not changed, the display quality is negligibly affected.

Although the voltage range of the data signal when the positive-polarity writing is specified is equal to the voltage range of the data signal when the negative-polarity writing, it is possible to suppress the voltage amplitude of the data due to the variations in voltages of the capacitive lines 132 even if the voltage ranges are equal to each other.

In this description, the second capacitive signal Vc2 is held at the voltage Vs1 such that the voltage of the $i^{th}$ capacitive line 132 is not changed when the scanning signal Y(i+1) becomes the H level in the $n^{th}$ frame for specifying the positive-polarity writing and the voltage of the $i^{th}$ capacitive line 132 is decreased by the voltage ΔV when the scanning signal Y(i+1) becomes the H level in the $(n+1)^{th}$ frame for specifying the negative-polarity writing, and the voltage of the pixel electrode 118 which is written when the scanning signal Yi becomes the H level is decreased by the voltage ΔVpix. However, the other configuration may be employed.

Figure 8:
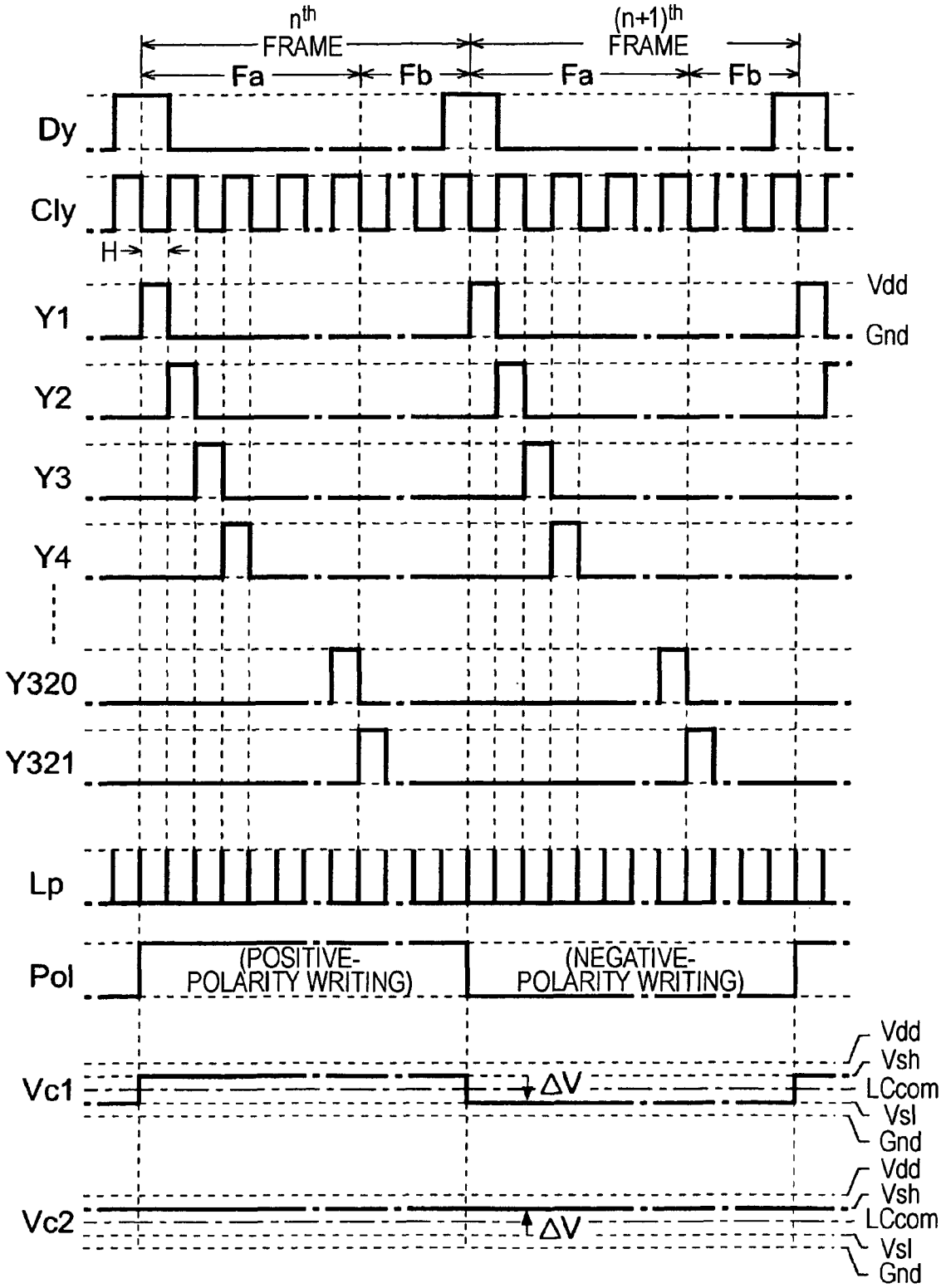
FIG. 8 is a view explaining another operation (1) of the electro-optical device.

For example, as shown in FIG. 8, the first capacitive signal Vc1 may be inverted and the second capacitive signal Vc2 may be held at the voltage Vsh such that the voltage of the $i^{th}$ capacitive line 132 is not changed when the scanning signal Y(i+1) becomes the H level in the frame for specifying the negative-polarity writing and the $i^{th}$ capacitive line 132 is increased by the voltage ΔV when the scanning signal Y(i+1) becomes the H level in the frame for specifying the negative-polarity writing [amend FIG. 8 to show negative polarity writing in $n^{th}$ frame and positive polarity writing in $(n+1)^{th}$ frame], and the pixel electrode 118 which is written when the scanning signal Yi becomes the H level may be increased by the voltage ΔVpix.

In this configuration, the voltage relationship of the data signal is opposed to the voltage LCcom shown in FIGS. 7A and 7B, the positive-polarity writing is changed to the negative-polarity writing, and the negative-polarity writing is changed to the positive-polarity writing.

Although, in this description, the surface inversion method for equalizing the polarities written to the pixels in one frame period and inverting the writing polarity is inverted in one frame period is employed, a scanning line inversion method for inverting the writing polarity in one row may be employed.

Figure 9:
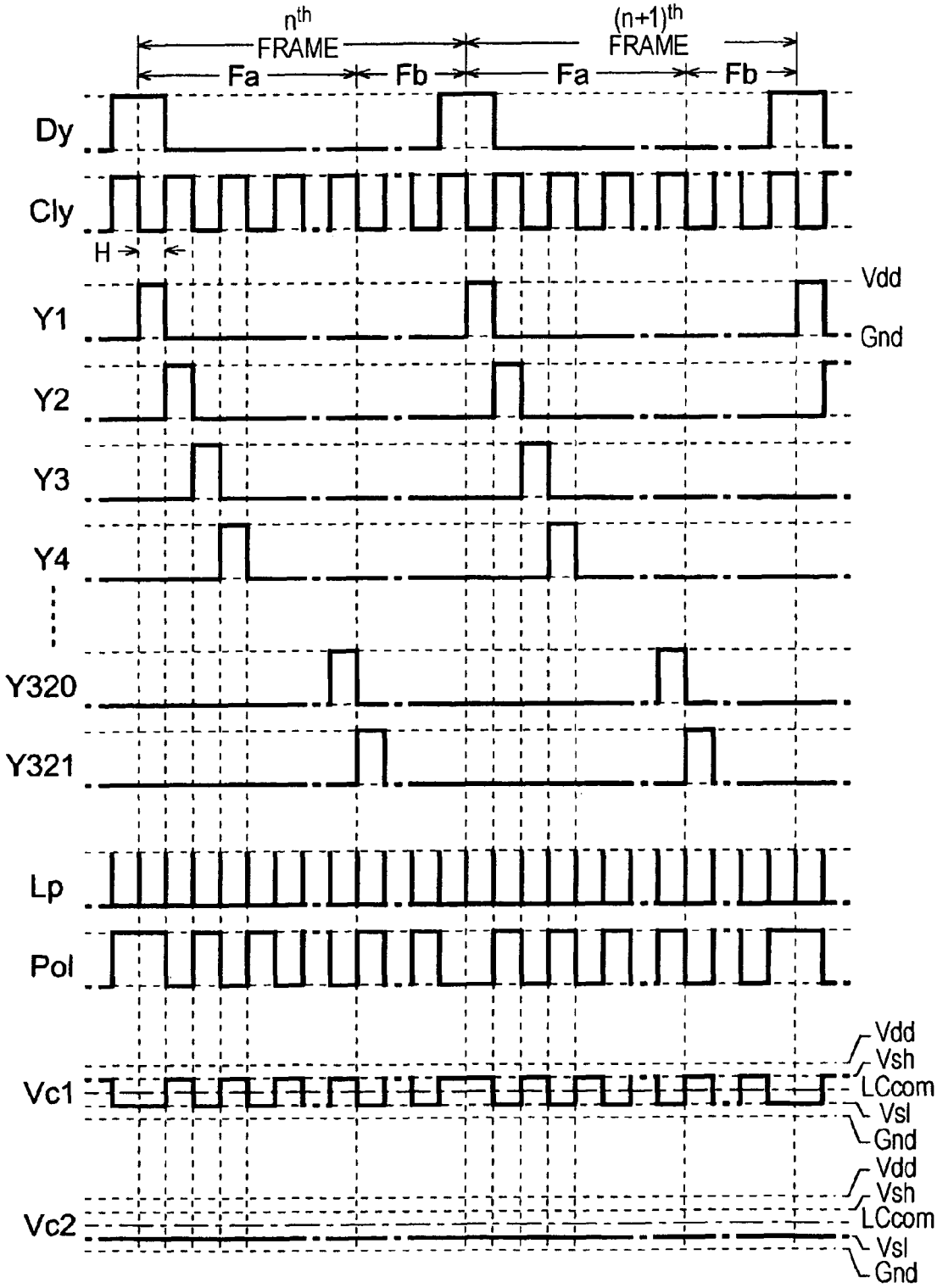
FIG. 9 is a view explaining another operation (2) of the electro-optical device.

In the scanning line inversion method, as shown in FIG. 9, the polarity specifying signal Pol is inverted in a horizontal scanning period H and inverted in a period in which the same scanning signal becomes the H level (the same scanning line is selected).

The first capacitive signal Vc1 becomes the voltage Vs1 when the polarity specifying signal Pol is at the H level and becomes the voltage Vsh when the polarity specifying signal Pol is at the L level.

Accordingly, in the $n^{th}$ frame of FIG. 9, the voltages of the odd-numbered (1, 3, 5, . . . , and 319) capacitive lines 132 are not changed even when the scanning signals to the even-numbered (2, 4, 6, . . . , and 320) scanning line 112 become the H level, but the voltages of the even-numbered capacitive lines 132 are decreased by the voltage ΔV when the scanning signals to the odd-numbered scanning lines 112 become the H level. Accordingly, in the $n^{th}$ frame of FIG. 9, the positive-polarity writing shown in FIG. 7A is performed in the odd-numbered rows and the negative-polarity writing shown in FIG. 7B is performed in the even-numbered rows.

In contrast, in the $(n+1)^{th}$ frame of FIG. 9, the voltages of the odd-numbered capacitive lines 132 are decreased by the voltage ΔV when the scanning signals to the even-numbered scanning lines 112 become the H level, but the voltages of the even-numbered capacitive lines 132 are not changed even when the voltages of the scanning signals to the odd-numbered scanning lines 112 become the H level. Accordingly, in the $(n+1)^{th}$ frame of FIG. 9, the negative-polarity writing shown in FIG. 7B is performed in the odd-numbered rows and the positive-polarity writing shown in FIG. 7A is performed in the even-numbered rows.

Although the second capacitive signal Vc2 has the voltage Vsl in FIG. 9, the voltage of the capacitive line 132 may be increased by ΔV to the voltage Vsh.

The voltage of the capacitive line 132 may be changed by ±ΔV as LCcom.

Figure 10:
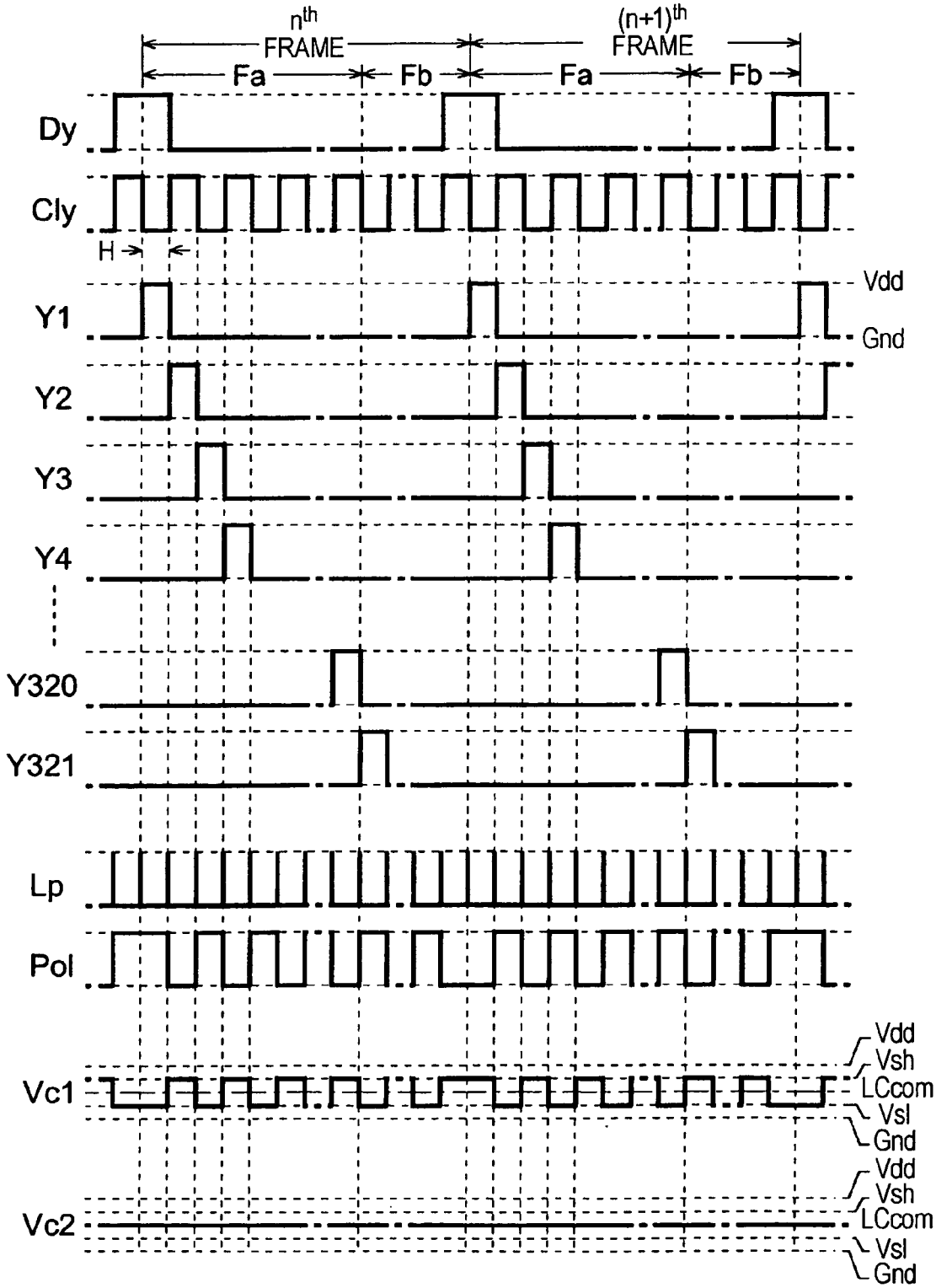
FIG. 10 is a view explaining another operation (3) of the electro-optical device.

In the scanning line inversion method, as shown in FIG. 10, the second capacitive signal Vc2 may be held at the voltage LCcom.

When the second capacitive signal Vc2 is held at the voltage LCcom, in the $n^{th}$ frame of FIG. 10, the voltages of the odd-numbered capacitive lines 132 are increased from the voltage Vsl to the voltage LCcom when the scanning signals to the even-numbered scanning lines 112 become the H level and are decreased from the voltage Vsh to the voltage LCcom when the scanning signals to the odd-numbered scanning lines 112 become the H level. In contrast, in the $(n+1)^{th}$ frame, the voltages of the odd-numbered capacitive lines 132 are decreased from the voltage Vsh to the voltage LCcom when the scanning signals to the even-numbered scanning lines 112 become the H level and are increased from the voltage Vsl to the voltage LCcom when the scanning signals to the odd-numbered scanning lines 112 become the H level.

Figure 11:
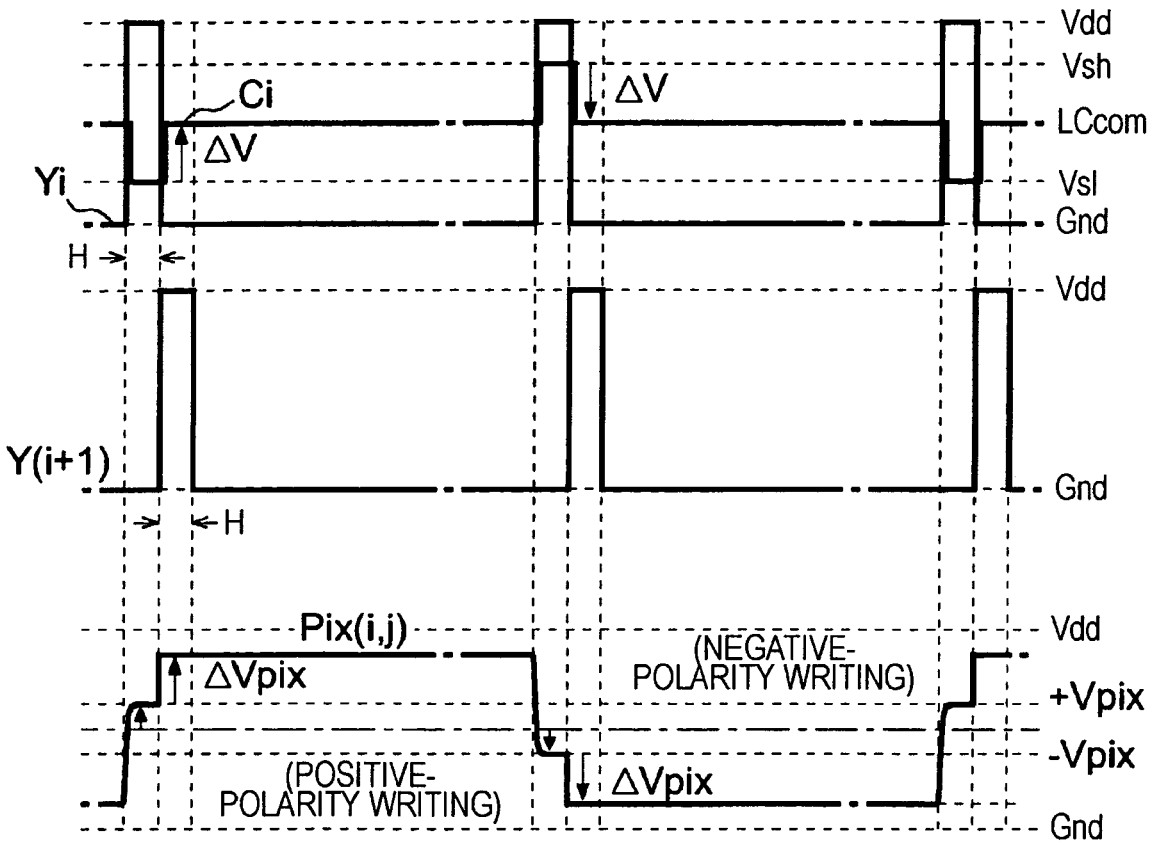
FIG. 11 is a voltage waveform diagram explaining the other operation (3).

Here, if the increase from the voltage Vsl to the voltage LCcom and the decrease from the voltage Vsh to the voltage LCcom are set to ΔV, as shown in FIG. 11, an operation for changing the voltage of the $i^{th}$ capacitive line 132 by the voltage ΔV when the scanning signal Y(i+1) becomes the H level so as to shift the voltage, which is written to the $i^{th}$ pixel electrode when the scanning signal Yi becomes the H level, by the voltage ΔVpix is alternately performed in one frame period for the positive-polarity writing and the negative-polarity writing.

Figure 12:
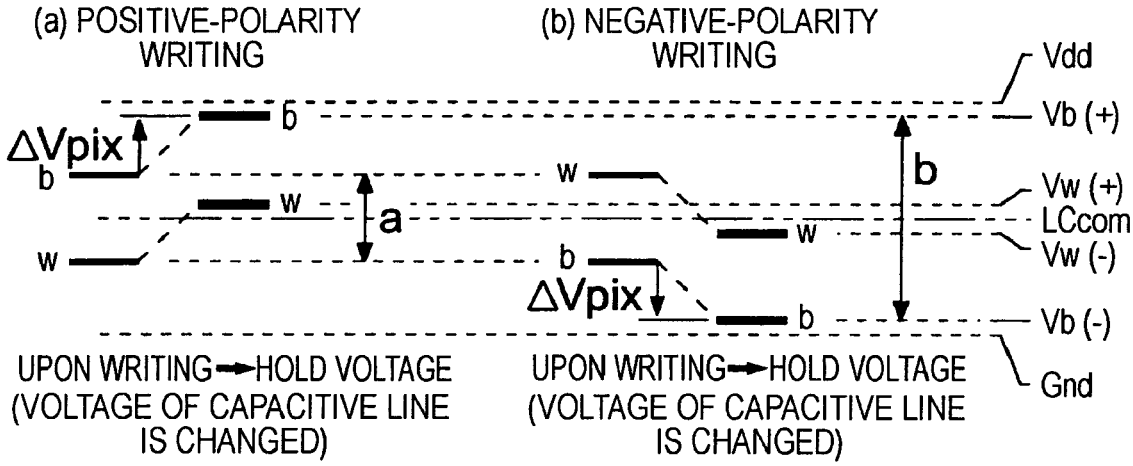
FIG. 12 is a view showing a relationship between a data signal and a hold voltage in the other operation (3).

The data signal has the effect shown in FIG. 7 where the voltage range when the negative-polarity writing is specified is equalized to the voltage range a when the positive-polarity writing is specified. That is, as shown in FIG. 12, in the $n^{th}$ frame for the positive-polarity writing, the center of the voltage range a is set to be matched to the voltage LCcom, and the voltage ΔV(=Vsh−LCcom=LCcom−Vs1) is set to be shifted from the voltage Vw(+) to the voltage Vb(+) when the voltage is increased by ΔVpix and is set to be shifted from the voltage Vw(−) to the voltage Vb(−) when the voltage is decreased by ΔVpix. In the voltage range a of FIG. 12, the white color w is at the L level and the black color B is at the H level if the positive-polarity writing is specified, and the white color w is at the H level and the black color b is at the L level if the negative-polarity writing is specified.

Even when the voltage range of the data signal when the positive-polarity writing is specified is not equal to the voltage range of the data signal when the negative-polarity writing is specified, it is possible to suppress the voltage amplitude of the data signal by the variations in voltages of the capacitive lines 132.

Application Example of First Embodiment

In the $i^{th}$ row of the capacitive line driving circuit 150, a period in which the TFTS 152, 154 and 156 are turned on is only the horizontal scanning period (H), but a period in which the TFT 158 is turned on is a non-selection period (a period in which the scanning signal Yi is at the L level) of the $i^{th}$ row. Since the period in which the TFT 158 is turned on is longer than the period in which the TFTs 152, 154 and 156 are turned on, the transistor characteristics are susceptible to be changed. The change in transistor characteristics described herein indicates that the gate voltage (threshold voltage) for turning on a switch is increased with time. With long-term use, a probability of a malfunction in which the TFT 158 is not turned on in the non-selection period is increased.

Accordingly, the application example for suppressing the probability of the malfunction will be described.

Figure 13:
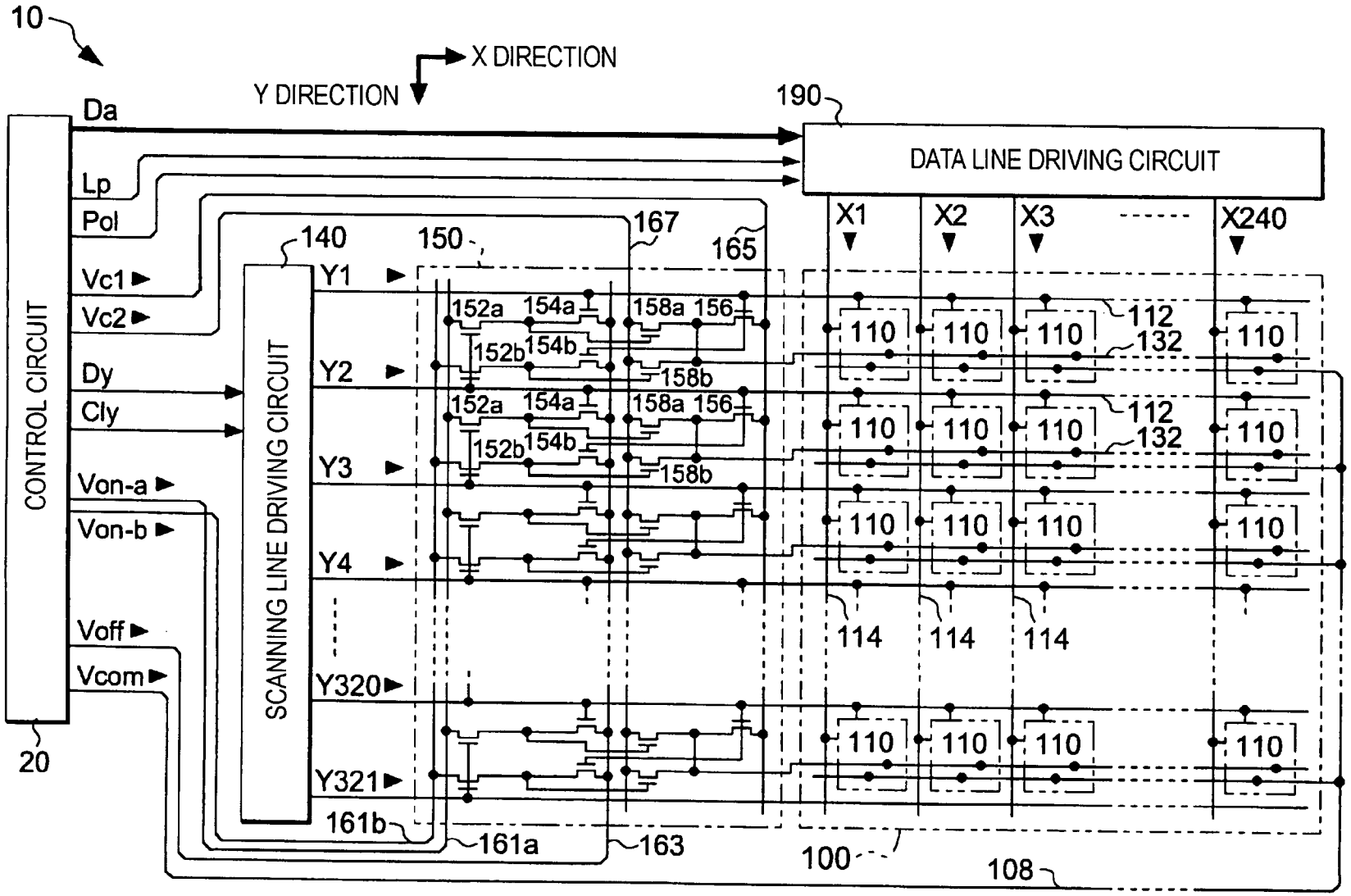
FIG. 13 is a view showing an application example of the electro-optical device.

FIG. 13 is a block diagram showing the configuration of an electro-optical device according to this application example.

As shown, in the application example, the TFT 158 is divided into TFTs 158*a* and 158*b* which are alternately used.

In more detail, in the capacitive line driving circuit 150 according to the application example, each row is divided into a line a and a line b. Among them, the line a has TFTs 152*a*, 154*a* and 158*a* and a source electrode of the TFT 152*a* is connected to a feed line 161*a*. In addition, the line b has TFTs 152*b*, 154*b* and 158*b* and a source electrode of the TFT 152*b* is connected to a feed line 161*b*.

Figure 15:
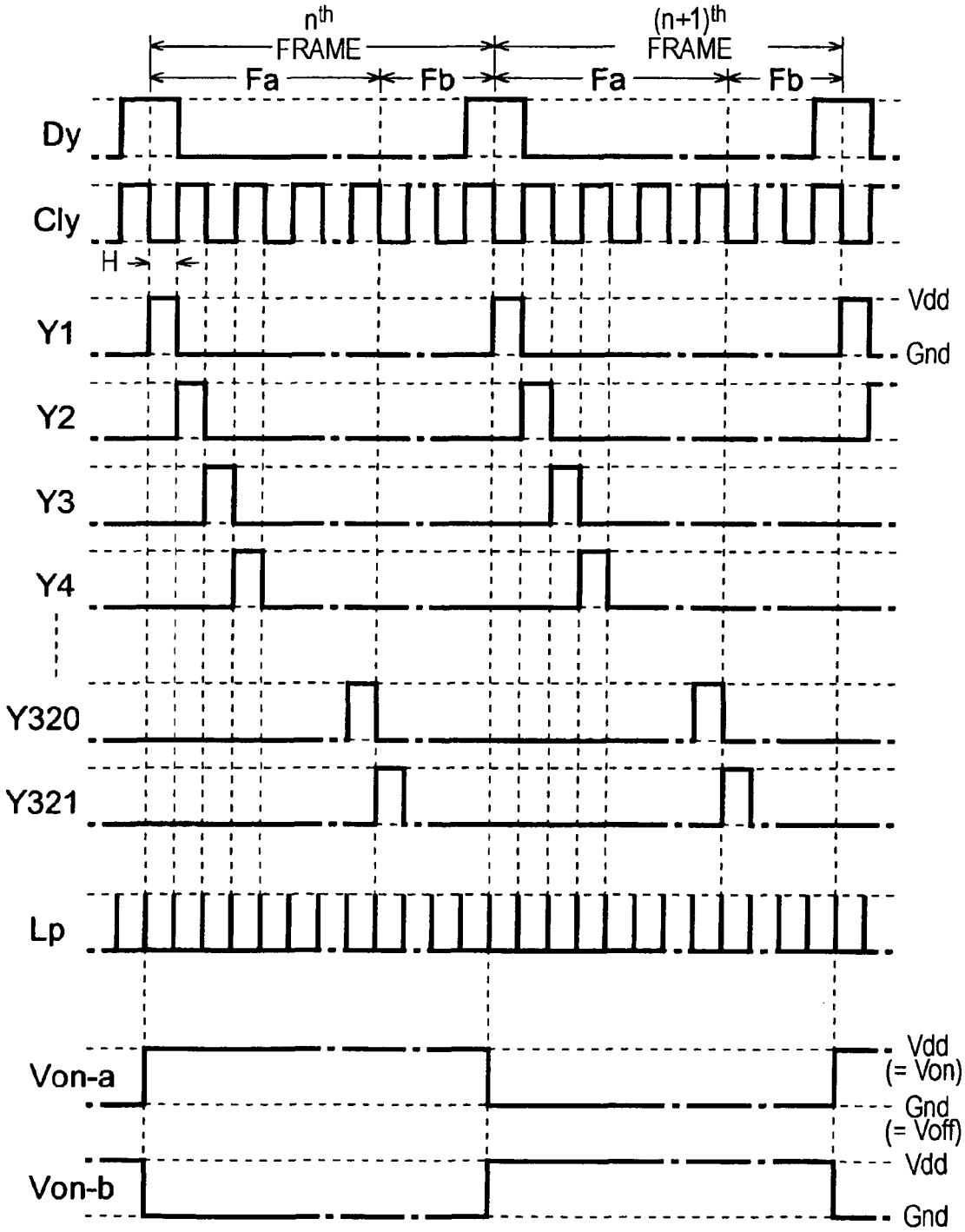
FIG. 15 is a view showing the waveforms signals Von-a and Von-b in the application example.

In this application example, the control circuit 20 supplies a signal Von-a to the feed line 161*a* and supplies a signal Von-b to the feed line 161*b*. As an example of the voltage waveforms of the signals Von-a and Von-b, for example, as shown in FIG. 15, in the $n^{th}$ frame, the signal Von-a becomes an on voltage Von and the signal Von-b becomes an off voltage Voff. In the next $(n+1)^{th}$ frame, the signal Von-a becomes the off voltage Voff and the signal Von-b becomes the on voltage Von.

In this application example, after selection, the TFT 152*a* connects the capacitive line 132 to the second feed line 167 in the $n^{th}$ frame in which the signal Von-a becomes the on voltage Von and the TFT 152*b* connects the capacitive line 132 to the second feed line 167 in the $(n+1)^{th}$ frame in which the signal Von-b becomes the on voltage Von. According to the application example, since the period in which the TFTs 152*a* and 152*b* are turned on is a half of that of the first embodiment, it is possible to suppress the probability of the malfunction due to the long-term use.

In the application example, the first capacitive signal Vc1, the second capacitive signal Vc2 and the polarity specifying signal Pol shown in FIGS. 8, 9 and 10 can be used.

Figure 14:
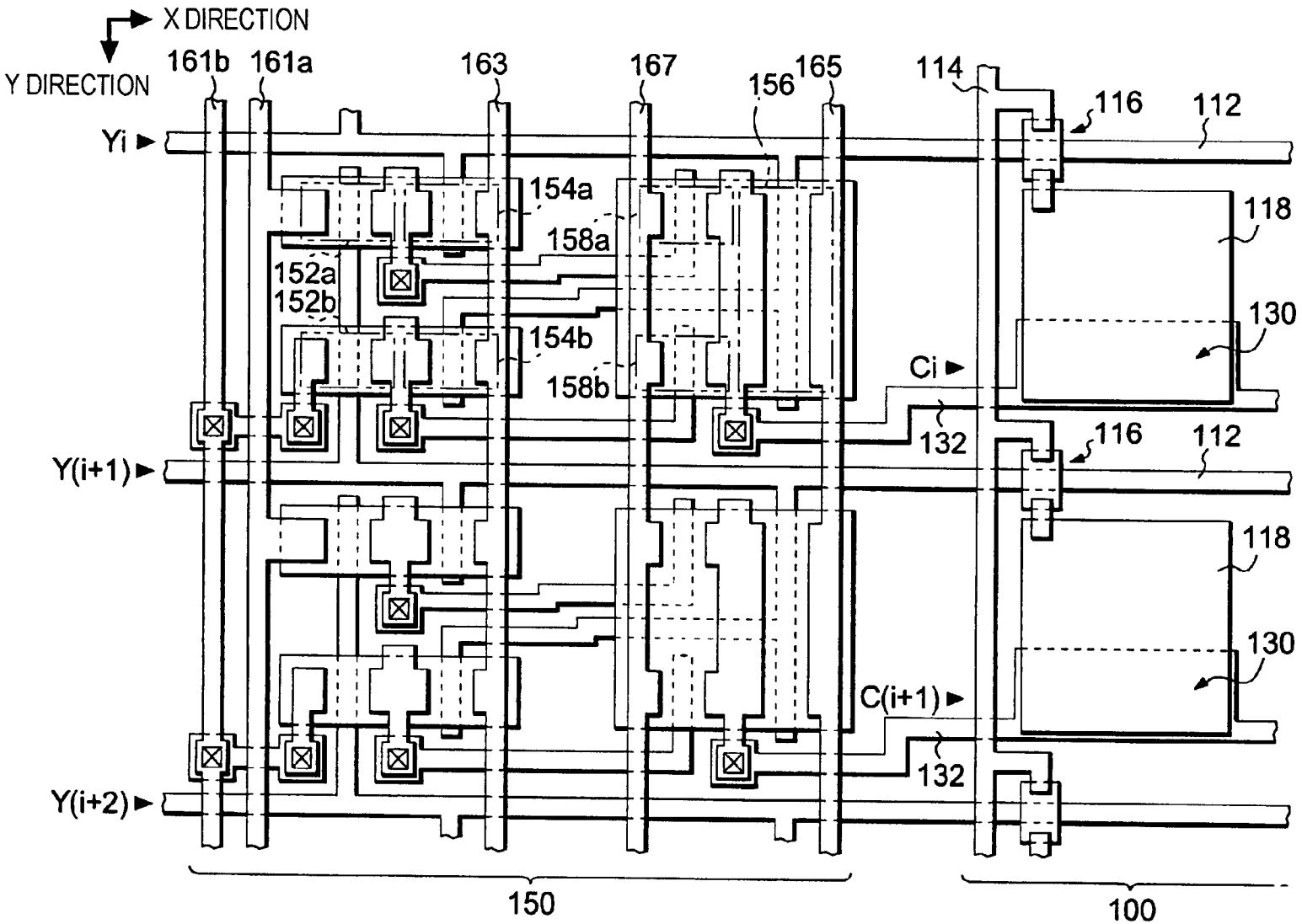
FIG. 14 is a view showing the configuration of the boundary between a display region and a capacitive line driving circuit in the application example.

FIG. 14 is a plan view showing the configuration in the vicinity of a boundary between the capacitive line driving circuit 150 and the display region 100 in the device substrate in the application example. As described above, the TFT 152 is divided into TFTs 152*a* and 152*b*, the TFT 154 is divided into TFTs 154*a* and 154*b*, and the TFT 158 is divided into TFTs 158*a* and 158*b*.

As shown in FIG. 14, the gate electrode of the TFT 154*a* of the $i^{th}$ row is branched from the $i^{th}$ scanning line 112 in the Y (downward) direction in the T-shape and the gate electrode of the TFT 154*b* of the $i^{th}$ row is branched from the gate electrode 156 of the TFT 156 of the $i^{th}$ row.

Although, in this application example, the voltages of the signals Von-a and Von-b are switched in one frame period, the invention is not limited to this. The voltages of the signals Von-a and Von-b do not need to be periodically switched and may be switched whenever a power source is turned on (off).

Although, in this application example, the TFT 158 is divided into two, TFT 158*a* and TFT 158*b*, the TFT 158 may be divided into at least three TFTs which are switched in predetermined order.

That is, since this application example is to decrease the period in which the TFT 158 is turned on (increase a period in which the TFT 158 is turned off) so as to reduce the change in transistor characteristics, in the non-selection period, among a plurality of TFTs 158, at least one TFT 158 is turned off and at least one TFT 158 is turned on.

Second Embodiment

Figure 16:
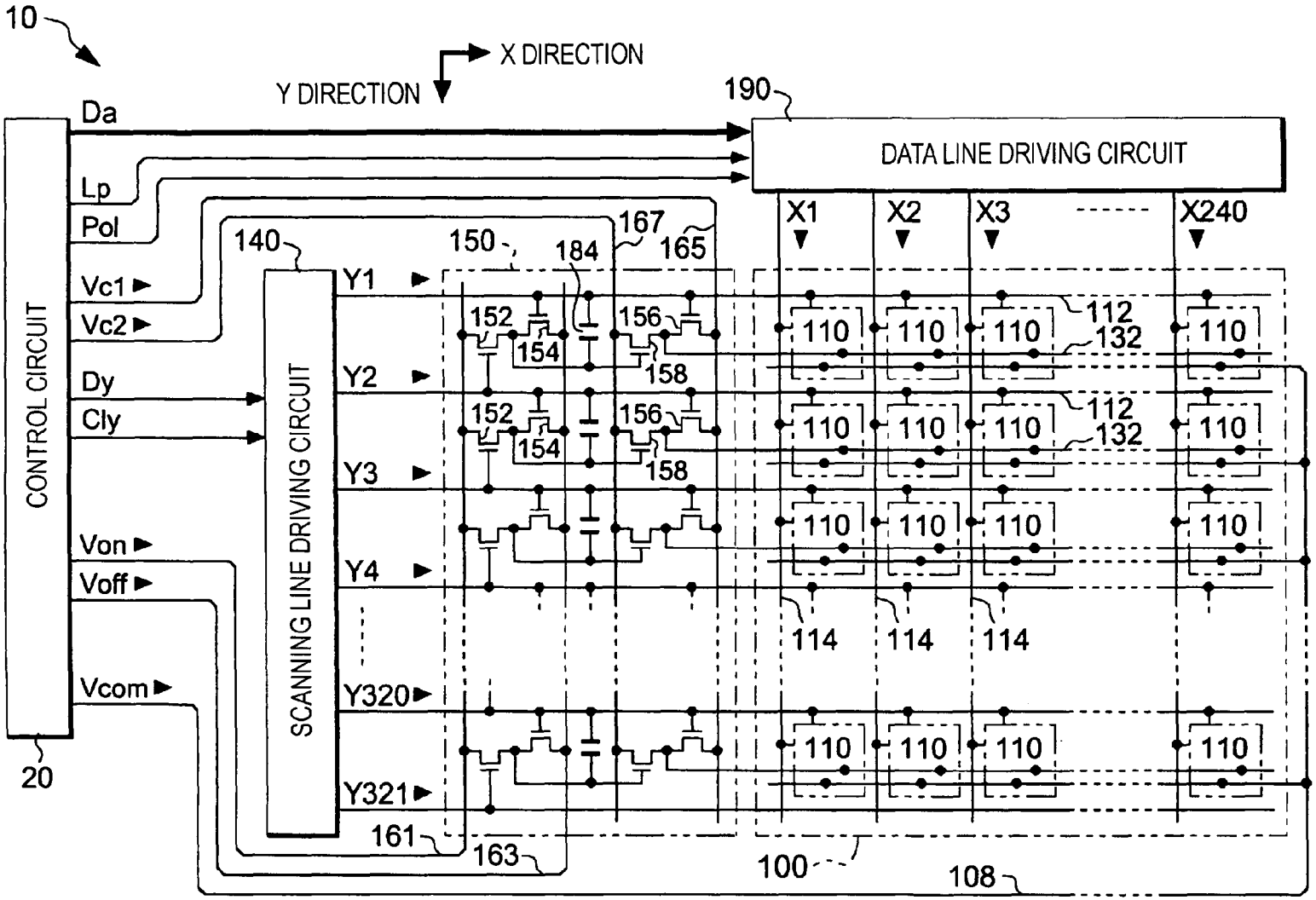
FIG. 16 is a view showing the configuration of an electro-optical device according to a second embodiment of the invention.

Next, a second embodiment of the invention will be described. FIG. 16 is a block diagram showing the configuration of an electro-optical device according to the second embodiment of the invention.

The configuration shown in FIG. 16 is different from the first embodiment (see FIG. 1) in that assistant capacitors 184 are provided in correspondence with the first to $320^{th}$ capacitive line 132. One end of the assistant capacitor 184 corresponding to the $i^{th}$ capacitive line 132 is connected to the gate electrode of the TFT 158 corresponding to the $i^{th}$ capacitive line 132 and the other end thereof is connected to the $i^{th}$ scanning line 112.

Figure 17:
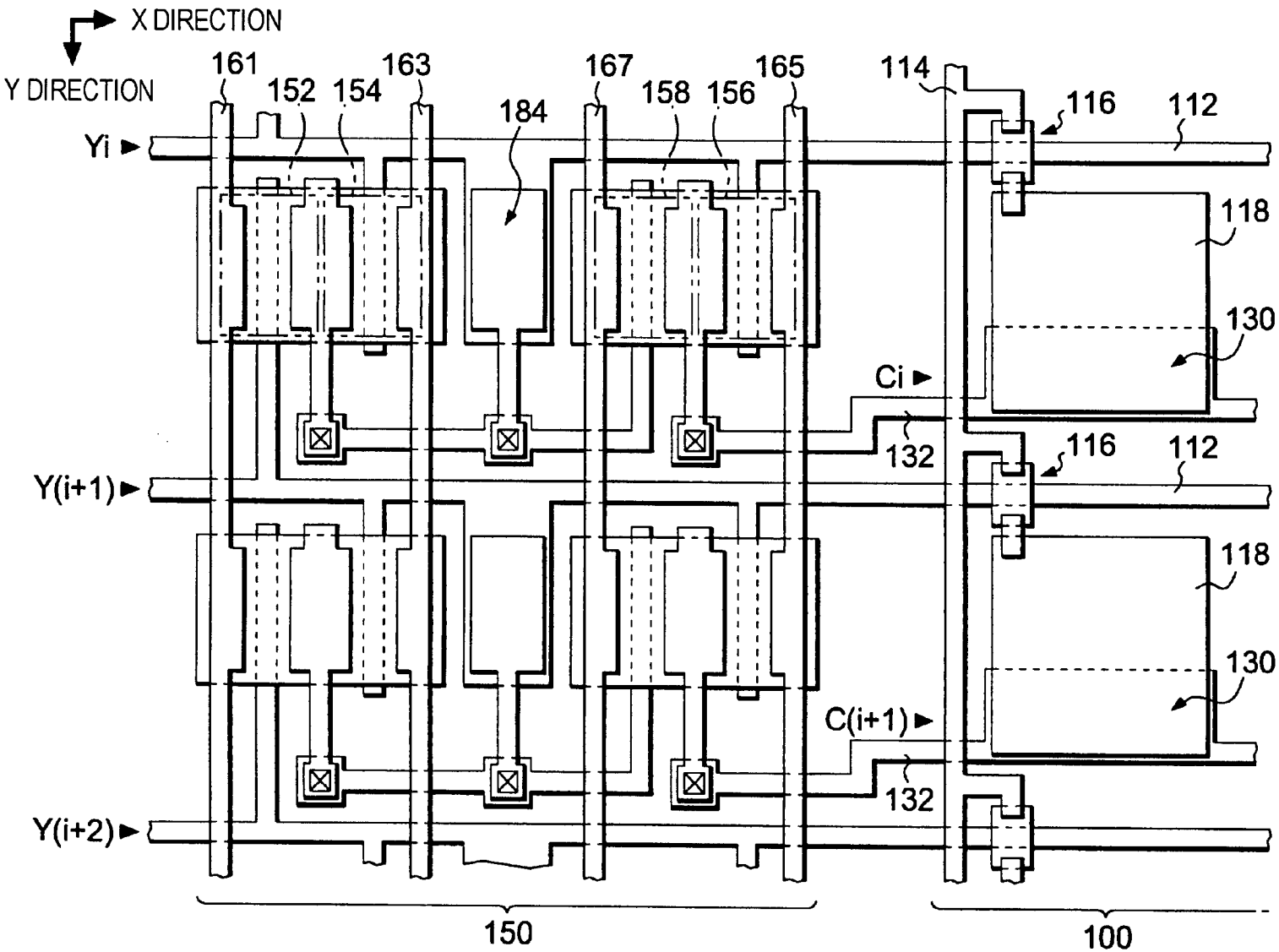
FIG. 17 is a view showing the configuration of a boundary between a display region and a capacitive line driving circuit in the electro-optical device.

FIG. 17 is a plan view showing the configuration of the vicinity of a boundary between the capacitive line driving circuit 150 and the display region 110 in the device substrate, according to the second embodiment.

The configuration shown in FIG. 17 is different from the first embodiment (see FIG. 3) in that the scanning line 112 has a large-width portion in the Y (downward) direction and a patterned electrode portion of a metal layer made of a third conductive layer is provided so as to overlap the large-width portion. Accordingly, the assistant capacitor 184 is configured by the large-width portion of the scanning line 112, the electrode portion patterned so as to overlap the large-width portion, and the gate insulating film interposed therebetween as a dielectric material.

This electrode portion is connected to the gate electrode of the TFT 158 via a contact hole.

If the assistant capacitor 184 is provided, the gate electrode of the TFT 158 is more stably held and thus deterioration in display quality can be further suppressed.

Since the assistant capacitor 184 of the $i^{th}$ row is provided to hold the TFT 158 just before the off state even when the scanning signals Yi and Y(i+1) are at the L level and the gate electrode of the TFT 158 corresponding to the $i^{th}$ capacitive line 132 is not dependent on a parasitic capacitor, the other end of the assistant capacitor 184 may be connected to ground Gnd.

Third Embodiment

In the scanning line inversion method (see FIGS. 9 and 10), the first capacitive signal Vc1 needs to be switched to voltages Vs1 and Vsh in the horizontal scanning period H. Accordingly, if a parasitic capacitor is included in the first feed line 165 for supplying the first capacitive signal Vc1, power is vainly consumed by voltage conversion. Accordingly, a third embodiment which solves such a problem will be described.

Figure 18:
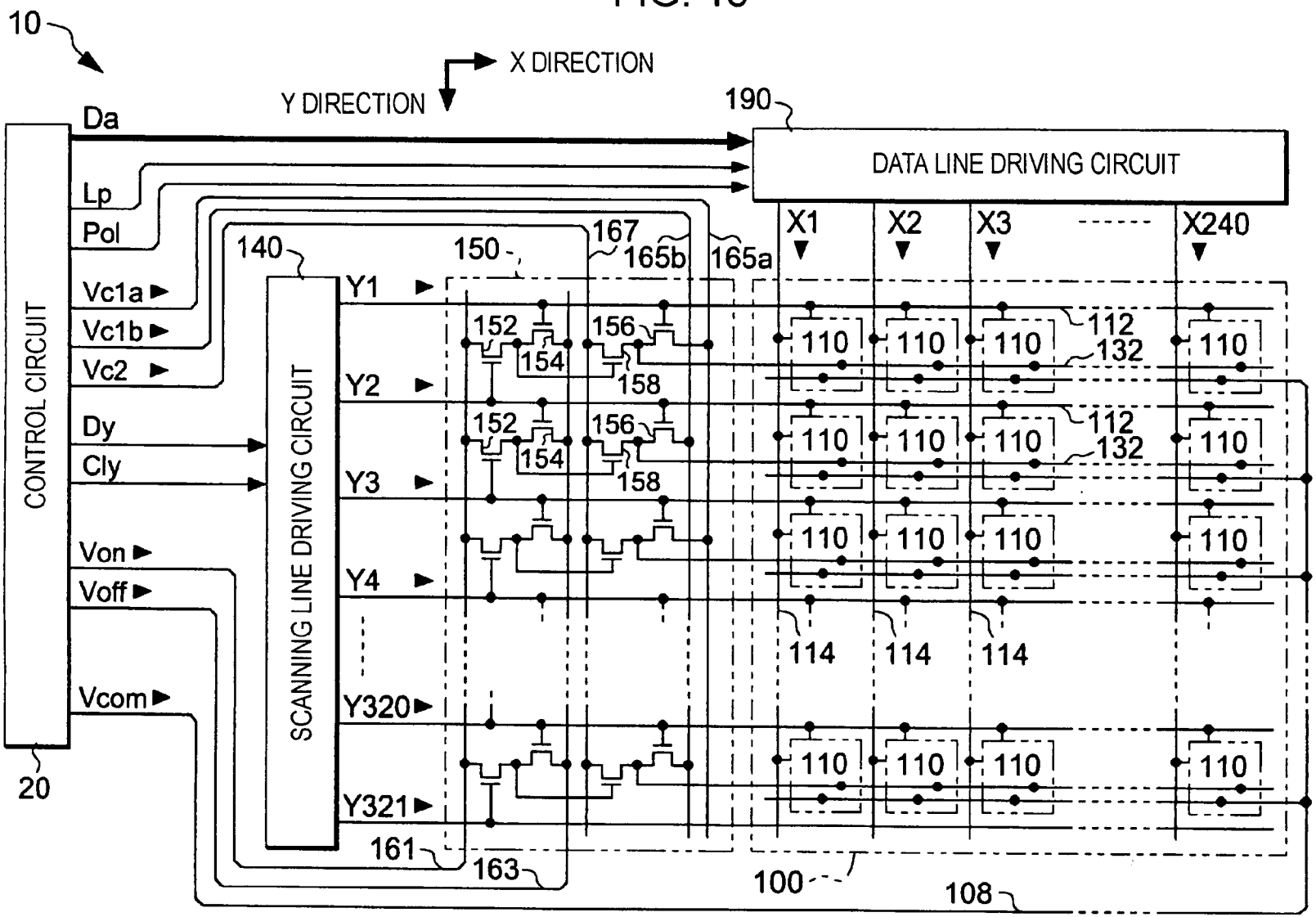
FIG. 18 is a view showing the configuration of an electro-optical device according to a third embodiment of the invention.

FIG. 18 is a block diagram showing the configuration of an electro-optical device according to the third embodiment of the invention. The configuration shown in FIG. 18 is different from the first embodiment (see FIG. 1) in that the control circuit 20 outputs two first capacitive signals and, in the capacitive line driving circuit 150, the source electrodes of the TFTs 156 corresponding to the odd-numbered capacitive lines 132 are connected to the feed line for supplying one of the two first capacitive signals and the source electrodes of the TFTs 156 corresponding to the even-numbered capacitive line 132 are connected to the feed line for supplying the other of the two first capacitive signals.

The other configuration is similar to that of the first embodiment and the description thereof will be omitted. Hereinafter, only the difference will be described.

In more detail, the control circuit 20 respectively supplies the first capacitive signals Vc1*a* and Vc1*b* to the first feed lines 165*a* and 165*b*, instead of the first capacitive signal Vc1.

Figure 20:
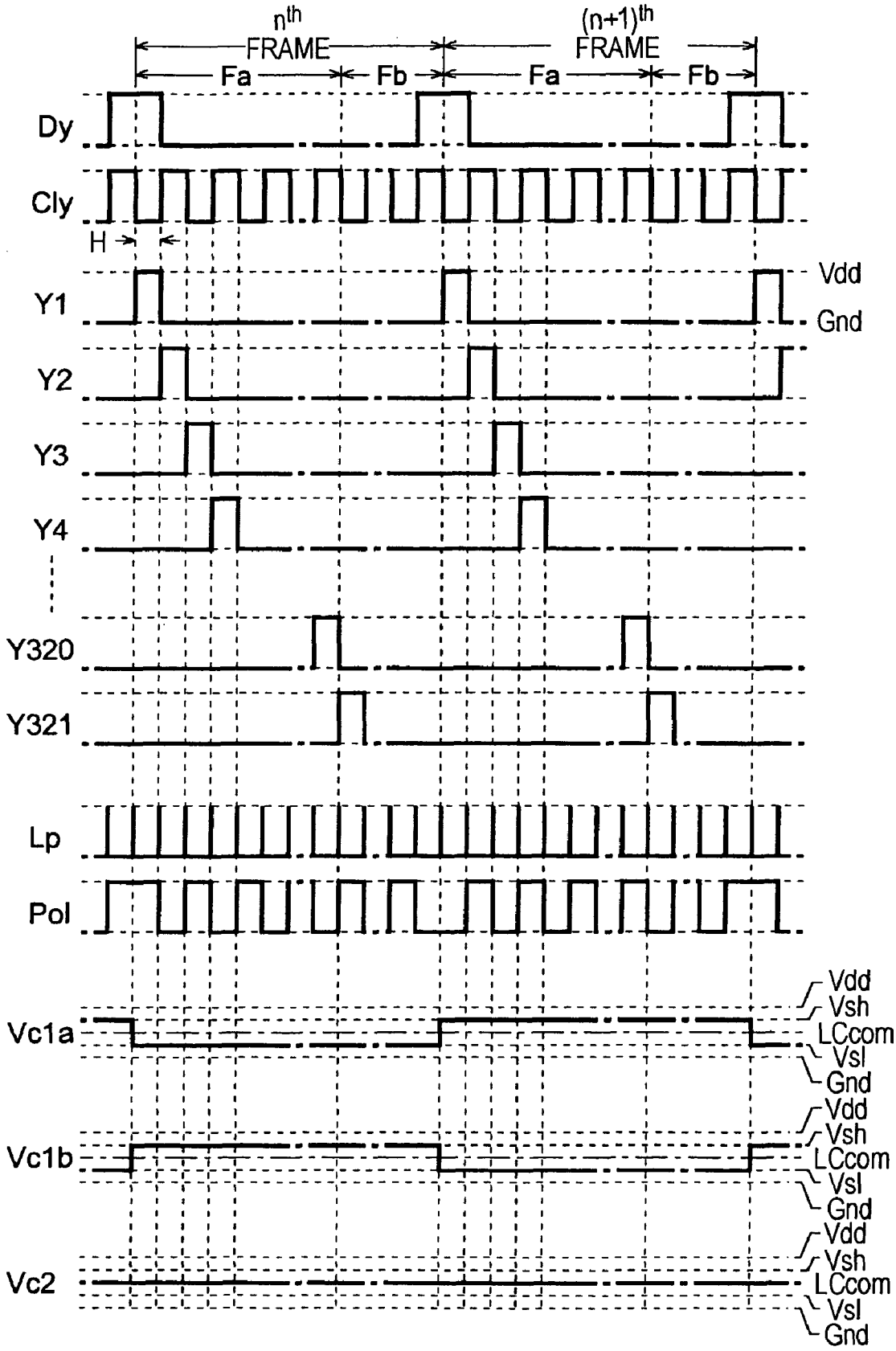
FIG. 20 is a view explaining an operation of the electro-optical device.

As shown in FIG. 20, the first capacitive signal Vc1*a* holds a constant voltage over each frame, becomes the voltage Vsl in the $n^{th}$ frame and becomes the voltage Vsh in the next $(n+1)^{th}$ frame. That is, in the first capacitive signal Vc1*a*, the voltages Vsl and Vsh are alternately switched in one frame period.

In contrast, the first capacitive signal Vc1*b* is opposed to the first capacitive signal Vc1*a* in the voltages Vsl and Vsh. That is, the first capacitive signal Vc1*b* becomes the voltage Vsh when the first capacitive signal Vc1*a* becomes the voltage Vsl in the $n^{th}$ frame and becomes the voltage Vsl when the first capacitive signal Vc1*a* becomes the voltage Vsh in the $(n+1)^{th}$ frame. The second capacitive signal Vc2 is held at the voltage LCcom.

In the capacitive line driving circuit 150, the source electrodes of the TFTs 156 corresponding to the odd-numbered capacitive lines 132 are connected to the first feed line 165*a* and the source electrodes of the TFTs 156 corresponding to the even-numbered capacitive lines 132 are connected to the first feed line 165*b*.

Figure 19:
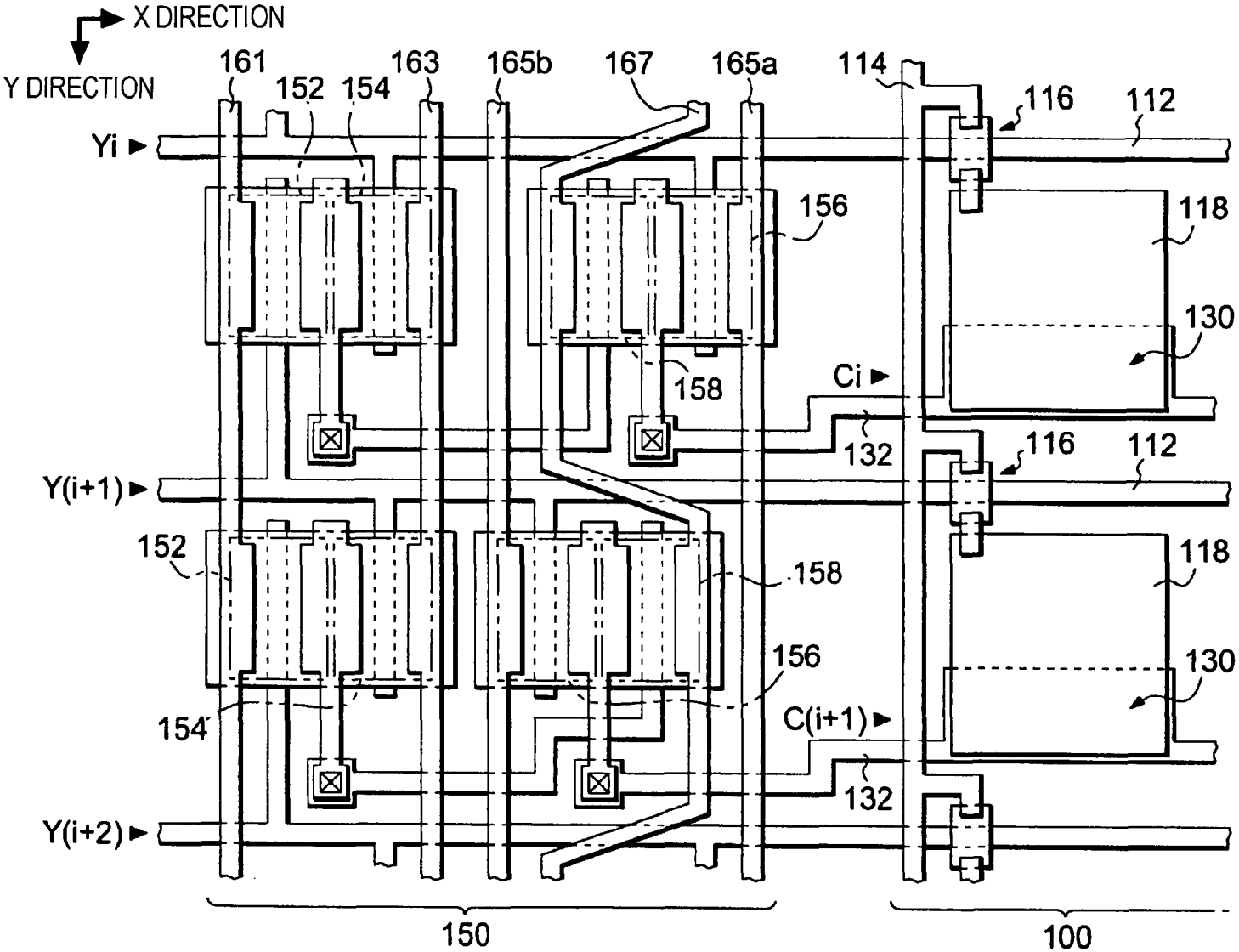
FIG. 19 is a view showing the configuration of a boundary between a display region and a capacitive line driving circuit in the electro-optical device.

FIG. 19 is a plan view showing the configuration of the vicinity of a boundary between the capacitive line driving circuit 150 and the display region 110 in the device substrate, according to the third embodiment.

As shown in FIG. 19, the second feed line 167 is bent to be located at the side of the first feed line 165*b* in the odd-numbered $i^{th}$ rows between the first feed lines 165 and 165*b* and to be located at the side of the first feed line 165*a* in the even-numbered $(i+1)^{th}$ rows.

A common semiconductor layer of the TFTs 156 and 158 is provided in a range from the second feed line 167 to the first feed line 165*a* in the X direction in the odd-numbered $i^{th}$ rows and is provided in a range from the first feed line 165*b* to the second feed line 167 in the X direction in the even-numbered $(i+1)^{th}$ row. Accordingly, the TFTs 156 and 158 corresponding to the odd-numbered $i^{th}$ row are provided at the opposite direction of the TFTs 156 and 158 corresponding to the even-numbered $(i+1)^{th}$ row.

In the third embodiment, for convenience of description, i indicates an odd number and (i+1) indicates an even number.

In the third embodiment, in the $n^{th}$ frame, the voltages of the capacitive lines 132 corresponding to the odd-numbered rows are increased by a voltage LCcom-Vsl because the first capacitive signal Vc1*a* becomes the voltage Vsl when the scanning signal of the same row becomes the H level and the second capacitive signal Vc2 becomes the voltage LCcom when the scanning signal of the next row becomes the H level. In contrast, the voltages of the capacitive lines 132 corresponding to the even-numbered rows are decreased by a voltage Vsh-LCcom because the first capacitive signal Vc1*b* becomes the voltage Vsh when the scanning signal of the same row becomes the H level and the second capacitive signal Vc2 becomes the voltage LCcom when the scanning signal of the next row becomes the H level.

In contrast, in the next $(i+1)^{th}$ frame, the voltages of the odd-numbered capacitive lines 132 are decreased by the voltage Vsh-LCcom when the scanning signal of the next row becomes the H level and the voltages of the even-numbered capacitive lines 132 are increased by the voltage LCcom-Vsl when the scanning signal of the next row becomes the H level.

Accordingly, in the third embodiment, as shown in FIGS. 9 and 10, since the voltage of the capacitive line 132 of each row is changed, it is possible to write the voltages to the pixels in the scanning line inversion method by supplying the data signals in the voltage range shown in FIG. 12.

In particular, according to the third embodiment, two first capacitive signals Vc1*a* and Vc1*b* are required, but the voltages of the first capacitive signals Vc1*a* and Vc1*b* are switched in the frame period, instead of the horizontal scanning period H. Accordingly, it is possible to suppress power from being vainly consumed by the parasitic capacitor due to the switching of the voltage.

Although, in the above-described embodiments, the data signals having the voltages according to the gradations of the pixels located at a selected scanning line are supplied to the data lines 114, the invention is not limited to this. For example, as shown in FIG. 21, the data signals X1, X2, X3, . . . , and X240 having the pulse widths according to the gradations of the pixels located at the selected scanning line may be supplied to the first, second, third, . . . , and $240^{th}$ data lines.

Figure 21:
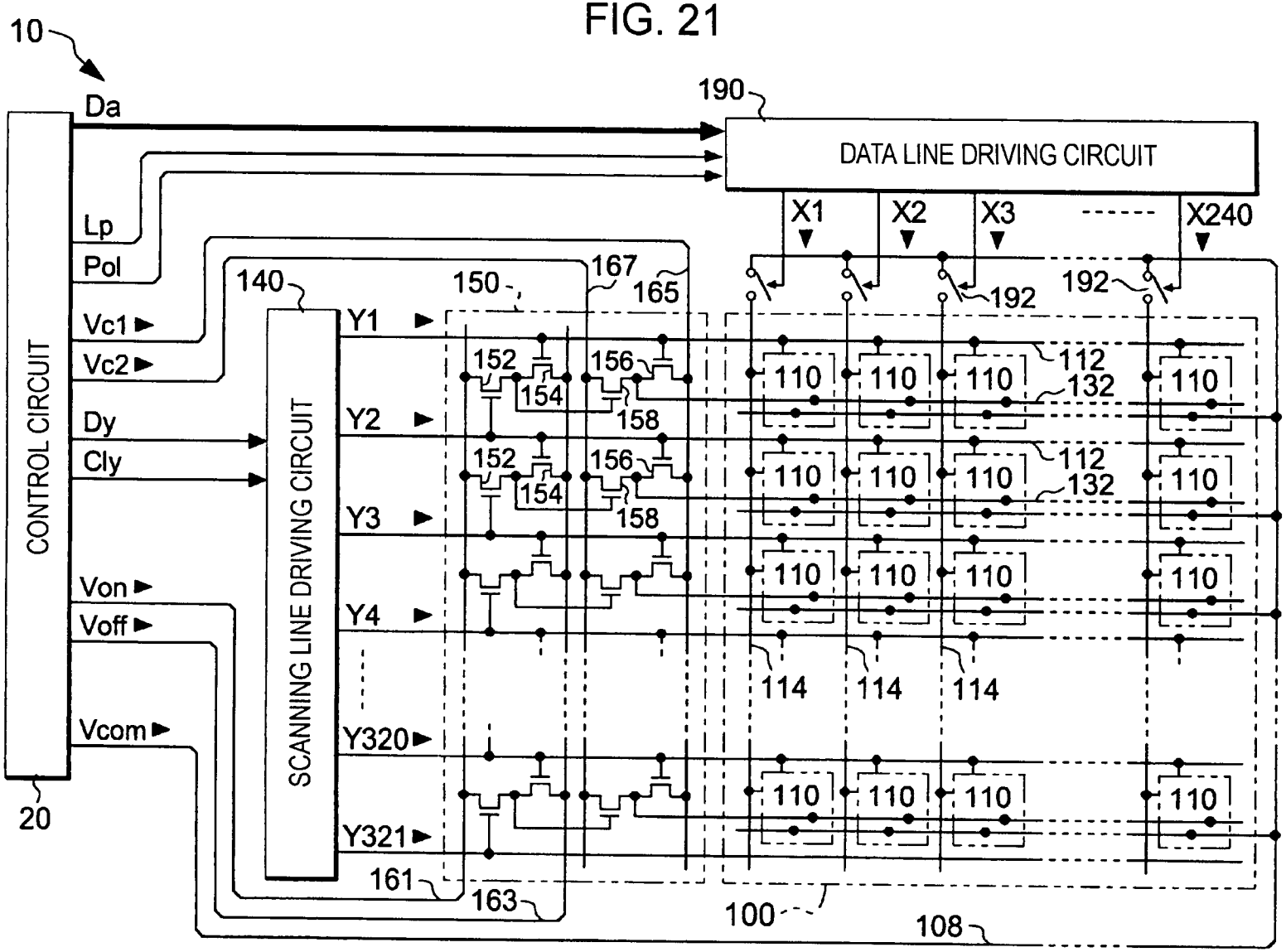
FIG. 21 is a view showing the configuration of an electro-optical device according to a modified example of the invention.

In this configuration, as shown in FIG. 21, switches 192 are provided in correspondence with the first, second, third, . . . , and $240^{th}$ data lines 114 and the switches 142 are turned on when the data signals X1, X2, X3, . . . , and X240 are at the H level (a period in which a pulse is output). One end of each of the switches 192 is respectively connected to a data line 114 and the other ends thereof are commonly connected to the common electrode 108.

The data line driving circuit 190 outputs the data signals having the (H-level) pulse widths according to the gradations of the pixels located at the selected scanning line such that a start end of the pulse becomes a selection start timing of the scanning line. Accordingly, the pulse width (H level) of the data signal Xj lengthens from the selection start timing of the scanning line such that the gradation of the pixel located at the $i^{th}$ row and the $j^{th}$ column becomes bright in a period in which the $i^{th}$ scanning line 112 is selected (normally white mode).

Figure 22:
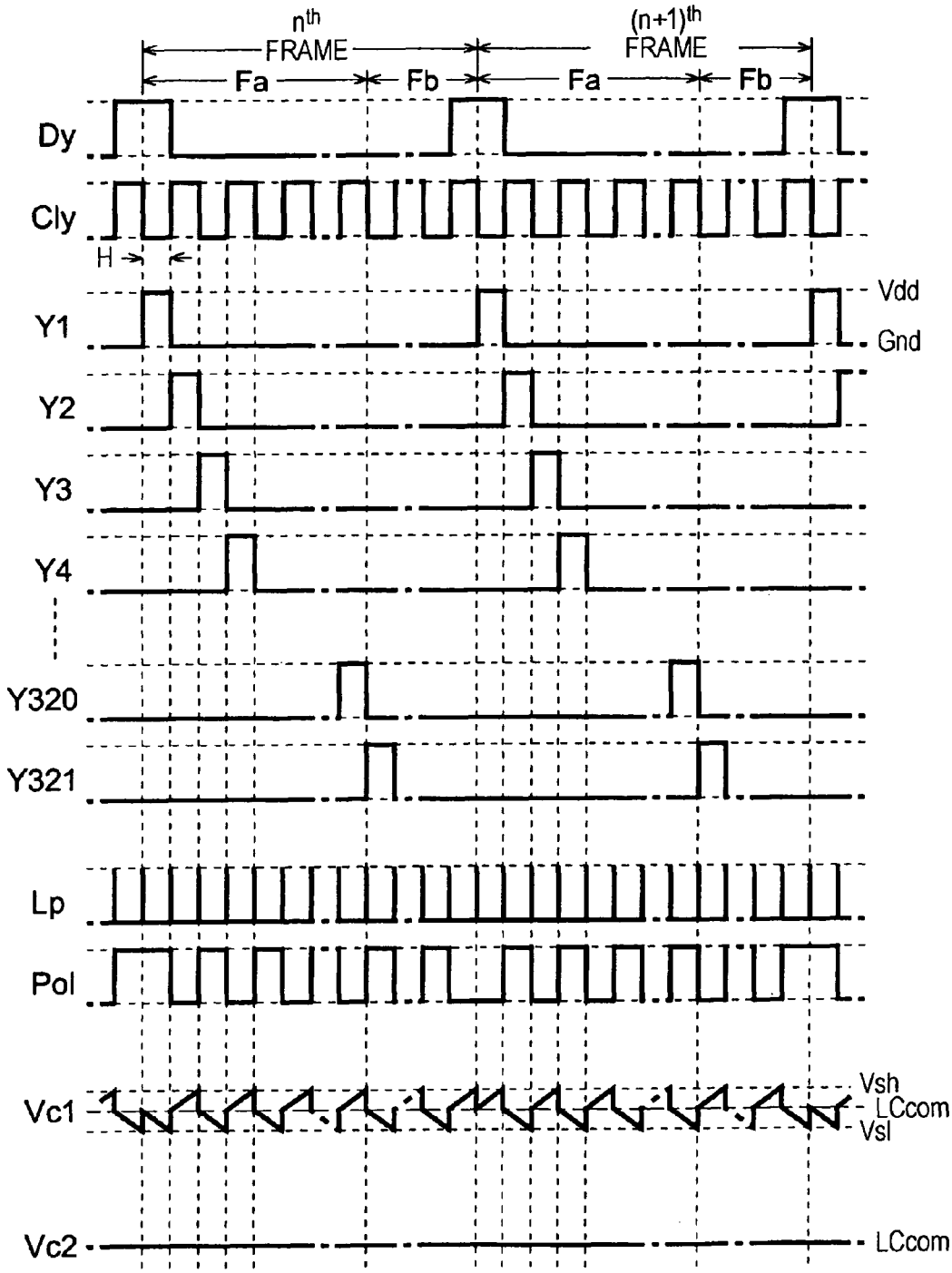
FIG. 22 is a view explaining an operation of the electro-optical device according to the modified example.

As shown in FIG. 22, the first capacitive signal Vc1 is a ramp signal which is decreased from the voltage LCcom at the selection start timing of the scanning line to the voltage Vsl at the selection end timing of the scanning line when the polarity specifying signal Pol is at the H level and a positive-polarity writing is specified and is increased from the voltage LCcom at the selection start timing of the scanning line to the voltage Vsh at the selection end timing of the scanning line when the polarity specifying signal Pol is at the L level and a negative-polarity writing is specified. The first capacitive signal Vc1 is supplied from the control circuit 20.

In the period in which the $i^{th}$ scanning line 112 is selected, the switch 192 corresponding to the $j^{th}$ data line 114 is turned on in a period according to the gradation of the pixel located at the $i^{th}$ row and the $j^{th}$ column from the selection start timing of the $i^{th}$ scanning line. Since the data line 114 has the same voltage LCcom as the common electrode 108 in the on period, the voltage is not charged in the pixel capacitor 120 located at the $i^{th}$ row and the $j^{th}$ column, but the ramp signal is supplied to the capacitive line 132 which is the other end of the storage capacitor 130 located at the $i^{th}$ row and the $j^{th}$ column. Accordingly, the difference voltage between the voltage of the ramp signal and the voltage LCcom is charged in the charge capacitor 130.

When the period according to the gradation of the pixel located at the $i^{th}$ row and the $j^{th}$ column elapses from the selection start timing of the $i^{th}$ scanning line, the pulse output of the data signal Xj is finished to turn off the switch 192 and thus the $j^{th}$ data line 114 becomes a high impedance state in which no electrical connection is made, but the voltage of the ramp signal is continuously changed, the pixel electrode 118 which is a serial connection point between the pixel capacitor 120 and the storage capacitor 130 is set to the voltage of the ramp signal at a time point when the switch 192 is turned off.

Accordingly, in the selection end timing of the $i^{th}$ scanning line, the voltage, of which the absolute value is increased as the period in which the switch 192 is turned on, is changed in the pixel capacitor 120 located at the $i^{th}$ row and the $j^{th}$ column.

In the selection start timing of the next $(i+1)^{th}$ scanning line, when the scanning signal Yi is at the H level, the voltage LCcom of the $i^{th}$ capacitive line 132 is increased by the voltage LCcom-Vsl if the positive-polarity writing is specified and is decreased by the voltage Vsh-LCcom if the negative-polarity writing is specified. Accordingly, similar to the example shown in FIG. 10, since the voltage of the pixel electrode 118 is shifted, the hold voltage of the pixel capacitor 120 can be set to the voltage according to the gradation.

Although, in the above-described embodiments, the gate electrode of the TFT 152 corresponding to the $i^{th}$ capacitive line 132 is connected to the next $(n+1)^{th}$ scanning line 112 in the capacitive line driving circuit 150, the gate electrode of the TFT 152 corresponding to the $i^{th}$ capacitive line 132 may be connected to the scanning line 112 separated by a predetermined number of rows m (m is an integer equal to or more than 2). However, if m is large, the gate electrode of the TFT 152 corresponding to the $i^{th}$ capacitive line 132 needs to be connected to the $(i+m)^{th}$ scanning line 112 and thus the lines become complicated.

In order to drive up to the TFT 152 corresponding to the $320^{th}$ capacitive line 132, m dummy scanning lines 112 are required. Like the embodiments, if m is "1", the fly-back period Fb is removed and the gate electrode of the TFT 152 corresponding to the $320^{th}$ capacitive line 132 is connected to the $i^{th}$ scanning line 112. For example, if m is "2", the fly-back period Fb is removed and the gate electrode of the TFT 152 corresponding to the $319^{th}$ and $320^{th}$ capacitive lines 132 are respectively connected to the first and second scanning lines 112. Thus, the dummy scanning lines do not need to be provided.

The voltage Vcom of the common electrode 108 may be at the low level when the positive-polarity writing is specified and may be at the high level when the negative-polarity writing is specified.

Although, in the embodiment, the pixel capacitor 120 is configured by the pixel electrode 118, the common electrode 108 and the liquid crystal 105 interposed therebetween and an electric field direction of the liquid crystal is the vertical direction of the substrate, the pixel capacitor may be configured by laminating the pixel electrode, an insulating film and the common electrode and the electric field direction of the liquid crystal may be the horizontal direction of the substrate.

Although, in the embodiments, the vertical scanning direction is the downward direction in FIG. 1 and thus the gate electrode of the TFT 152 corresponding to the $i^{th}$ capacitive line 132 is connected to the $(i+1)^{th}$ scanning line 112, the gate electrode of the TFT 152 corresponding to the $i^{th}$ capacitive line 132 may be connected to the $(i-1)^{th}$ scanning line 112 if the vertical scanning direction is the upward direction. That is, the gate electrode of the TFT 152 corresponding to the $i^{th}$ capacitive line 132 may be connected to the scanning line other than the $i^{th}$ scanning line, that is, the scanning line selected after the $i^{th}$ scanning line selected.

In the above-described embodiments, in the unit of the pixel capacitor 120, the writing polarity is inverted in one frame period in order to only AC-drive the pixel capacitor 120. Accordingly, the inversion period may be at least two frame periods.

Although the pixel capacitor 120 is in the normally white mode, a normally black mode in which a dark state is held in a state in which a voltage is not applied may be employed. Three pixels of red (R), green (G) and blue (B) may configure one dot to perform a multi-color display or four pixels of red (R), green (G), blue (B) and cyan (C) may configure one dot, thereby improving color reproducibility.

In the above description, the reference of the writing polarity is the voltage LCcom applied to the common electrode 108, but this is applicable when the TFT 116 of the pixel 110 functions as an ideal switch. Actually, a phenomenon (a push-down phenomenon, punch-through phenomenon or a field-through phenomenon) in which the voltage of the drain (pixel electrode 118) is decreased when the on state is switched to the off state due to the parasitic capacitor between the gate and the drain of the TFT 116 occurs. In order to prevent deterioration in liquid crystal, the pixel capacitor 120 should be AC-driven. However, the pixel capacitor 120 is AC-driven using the voltage applied to the common electrode 108 as the reference of the writing polarity, the effective voltage value of the pixel capacitor 120 due to the negative-polarity writing is slightly larger than the effective value due to the positive-polarity writing due to the push-down phenomenon (if the TFT 116 is the n channel type). Accordingly, the reference voltage of the writing polarity and the voltage LCcom of the common electrode 108 are separately set and, in more detail, the reference voltage of the writing polarity may be set to be higher than the voltage LCcom so as to remove the push-down phenomenon.

Since the storage capacitor 130 is insulated in DC, the difference in the voltage LCcom is not restricted to a predetermined value as long as the difference in voltage applied to the first feed line 165 and the second feed line 167 has the above-described relationship.

Electronic Apparatus

Figure 23:
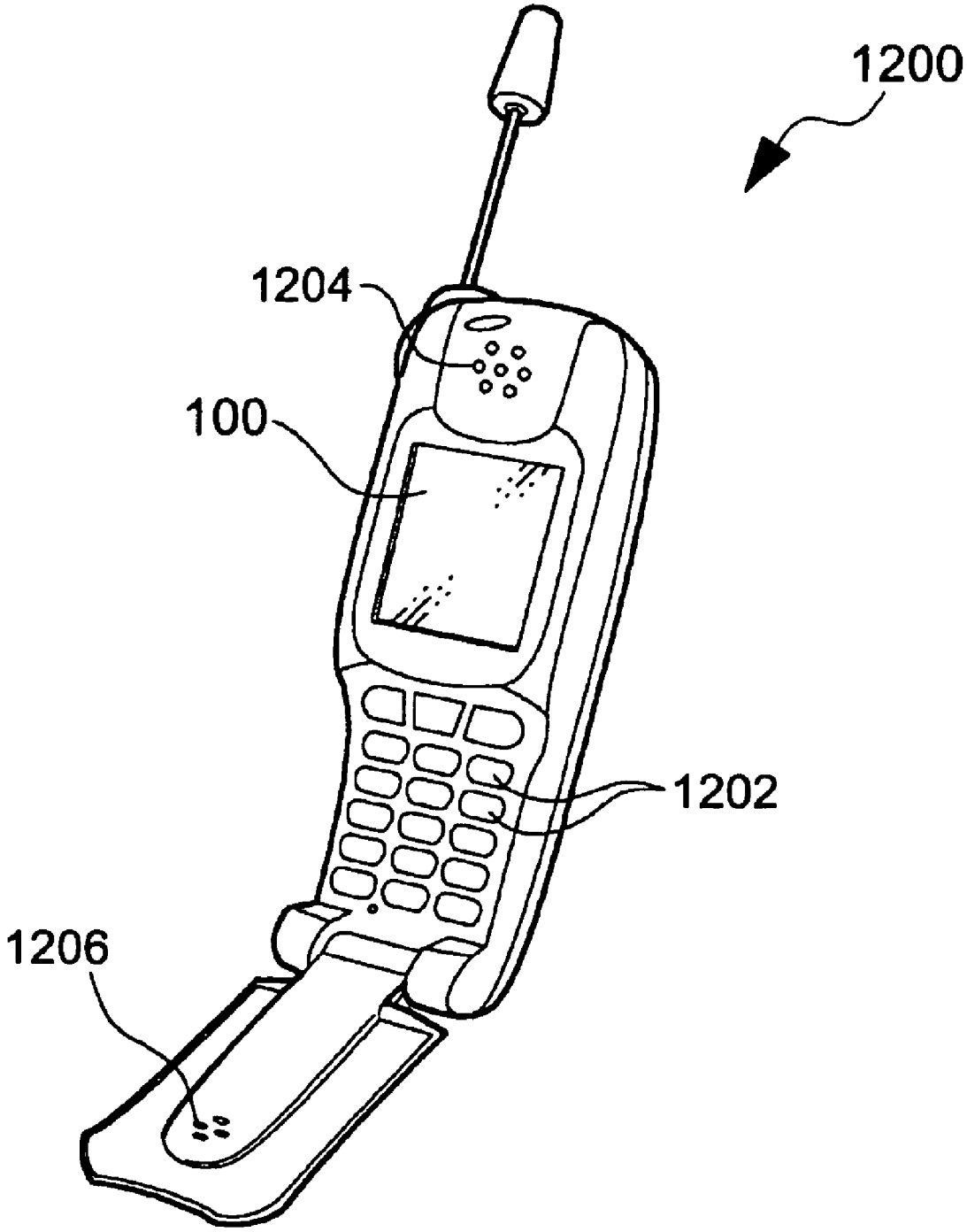
FIG. 23 is a view showing the configuration of a mobile telephone using the electro-optical device according the embodiment.

Next, an electronic apparatus having the electro-optical device 10 according to any one of the above-described embodiments as a display device will be described. FIG. 23 is a view showing the configuration of a mobile telephone 1200 using the electro-optical device 10 according to any one of the embodiments.

As shown in FIG. 23, the mobile telephone 1200 includes a plurality of operation buttons 1202, an ear piece 1204, a mouthpiece 1206, and the above-described electro-optical device 10. In the electro-optical device 10, the components corresponding to the display region 100 are not shown as an appearance.

As the electronic apparatus including the electro-optical device 10, in addition to the mobile telephone shown in FIG. 23, there are a digital camera, a mobile personal computer, a liquid crystal television set, a viewfinder-type or direct-view monitor type video tape recorder, a car navigation system, a pager, an electronic organizer, an electronic calculator, a word processor, a workstation, a videophone, a POS terminal, a touch-panel-equipped device. The above-described electro-optical device 10 is applicable as a display unit of such exemplary electronic apparatuses.

The entire disclosure of Japanese Patent Application Nos. 2006-157009, filed Jun. 6, 2006 and 2007-071977, Mar. 20, 2007 are expressly incorporated by reference herein.

What is claimed is:

1. A driving circuit of an electro-optical device, the driving circuit comprising:

a plurality of rows of scanning lines;

a plurality of columns of data lines;

a plurality of capacitive lines provided in correspondence with the plurality of rows of scanning lines;

pixels provided in correspondence with intersections of the plurality of rows of scanning lines and the plurality of columns of data lines, each of the pixels including:

a pixel switching element of which one end is connected to the data line corresponding thereto and which becomes a conduction state when the scanning line corresponding thereto is selected, a pixel capacitor interposed between the pixel switching element and a common electrode, and a storage capacitor interposed between one end of the pixel capacitor and the capacitive line provided in correspondence with the scanning line;

a scanning line driving circuit which selects the scanning lines in predetermined order;

a capacitive line driving circuit which selects a first feed line when one scanning line is selected, selects a second feed line until the one scanning line is selected again after selecting a scanning line, which is separated from the one scanning line by a predetermined row and is selected after the one scanning line, and applies voltages of the selected feed lines, with respect to the capacitive line corresponding to the one scanning line; and a data line driving circuit which supplies data signals corresponding to gradations of the pixels to the pixels corresponding to the selected scanning line via data lines, wherein the capacitive line driving circuit includes first to fourth transistors in correspondence with each of the capacitive lines, the first transistor corresponding to one capacitive line includes a gate electrode which is connected to a scanning line separated from the scanning line corresponding to the one capacitive line by a predetermined row and a source electrode which is connected to an on-voltage feed line for feeding an on voltage for turning on the fourth transistor, the second transistor includes a gate electrode which is connected to the scanning line corresponding to the one capacitive line and a source electrode which is connected to an off-voltage feed line for feeding an off voltage for turning off the fourth transistor, the third transistor includes a gate electrode which is connected to the scanning line corresponding to the one capacitive line and a source electrode which is connected to the first feed line, the fourth transistor includes a gate electrode which is commonly connected to drain electrodes of the first and second transistors and a source electrode which is connected to the second feed line, and drain electrodes of the third and fourth transistors are connected to the one capacitive line.

2. The driving circuit according to claim 1, wherein the voltages of the first and second feed lines are set such that the voltage of the one capacitive line is changed when the scanning line separated from the scanning line corresponding to the one capacitive line by a predetermined row is selected.

3. The driving circuit according to claim 2, wherein the voltage of the first feed line is switched between two different voltages in a predetermined period, and the voltage of the second feed line is constant.

4. The driving circuit according to claim 3, wherein the voltage of the second feed line is an intermediate value between two voltages of the first feed line.

5. The driving circuit according to claim 2, wherein the voltages of the first and second feed lines are complementarily switched between two different voltages whenever the scanning line is selected.

6. The driving circuit according to claim 1, wherein one capacitive line has a plurality of sets of the first, second and fourth transistors, and the fourth transistor for connecting the one capacitive line to the second feed line is switched from the plurality of sets in predetermined order.

7. The driving circuit according to claim 1 wherein:

assistant capacitors are provided in correspondence with the capacitive lines, and one end of the assistant capacitor corresponding to one capacitive line is connected to the gate electrode of the fourth transistor and the other end thereof is held at a constant voltage in a period from a time point when at least a scanning line separated from the scanning line corresponding to the one capacitive line by a predetermined row is selected to a time point when the one scanning line is selected again.

8. The driving circuit according to claim 7, wherein the other end of the assistant capacitor corresponding to the one capacitive line is connected to the scanning line corresponding to the one capacitive line.

9. The driving circuit according to claim 1, wherein:

the first feed line is divided into a first feed line for an odd-numbered row and a first feed line for an even-numbered row, the source electrode of the third transistor of the capacitive line corresponding to the odd-numbered row is connected to the first feed line for the odd-numbered row and the source electrode of the third transistor of the capacitive line corresponding to the even-numbered row is connected to the first feed line for the even-numbered row, and one of two different voltages is applied to the first feed line corresponding to the odd-numbered row, the other of the two different voltages is applied to the first feed line corresponding to the even-numbered row, and the two different voltages are complentarily switched in a predetermined period.

10. An electro-optical device comprising:

a plurality of rows of scanning lines;

a plurality of columns of data lines;

a plurality of capacitive lines provided in correspondence with the plurality of rows of scanning lines;

pixels provided in correspondence with intersections of the plurality of rows of scanning lines and the plurality of columns of data lines, each of the pixels including a pixel switching element of which one end is connected to the data line corresponding thereto and which becomes a conduction state when the scanning line corresponding thereto is selected, a pixel capacitor of which one end is connected to the other end of the pixel switching element and the other end is connected to a common electrode, and a storage capacitor interposed between one end of the pixel capacitor and the capacitive line provided in correspondence with the scanning line;

a scanning line driving circuit which selects the scanning lines in predetermined order;

a capacitive line driving circuit which selects a first feed line when one scanning line is selected, selects a second feed line until the one scanning line is selected again after selecting a scanning line, which is separated from the one scanning line by a predetermined row and is selected after the one scanning line, and applies voltages of the selected feed lines, with respect to the capacitive line corresponding to the one scanning line; and a data line driving circuit which supplies data signals corresponding to gradations of the pixels to the pixels corresponding to the selected scanning line via data lines, wherein the capacitive line driving circuit includes first to fourth transistors in correspondence with each of the capacitive lines, the first transistor corresponding to one capacitive line includes a gate electrode which is connected to a scanning line separated from the scanning line corresponding to the one capacitive line by a predetermined row and a source electrode which is connected to an on-voltage feed line for feeding an on voltage for turning on the fourth transistor, the second transistor includes a gate electrode which is connected to the scanning line corresponding to the one capacitive line and a source electrode which is connected to an off-voltage feed line for feeding an off voltage for turning off the fourth transistor, the third transistor includes a gate electrode which is connected to the scanning line corresponding to the one capacitive line and a source electrode which is connected to the first feed line, the fourth transistor includes a gate electrode which is commonly connected to drain electrodes of the first and second transistors and a source electrode which is connected to the second feed line, and drain electrodes of the third and fourth transistors are connected to the one capacitive line.

11. An electronic apparatus comprising the electro-optical device according to claim 10.

* * * * *